US009291979B2

(12) United States Patent
Yoshida et al.

(10) Patent No.: US 9,291,979 B2
(45) Date of Patent: Mar. 22, 2016

(54) DEVICE, SYSTEM, METHOD, AND RECORDING MEDIUM HAVING COMPUTER PROGRAM FOR CONTROLLING PRINTING

(71) Applicants: Makoto Yoshida, Kanagawa (JP); Hiroaki Suzuki, Chiba (JP)

(72) Inventors: Makoto Yoshida, Kanagawa (JP); Hiroaki Suzuki, Chiba (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/578,871

(22) Filed: Dec. 22, 2014

(65) Prior Publication Data

US 2015/0185678 A1 Jul. 2, 2015

(30) Foreign Application Priority Data

Dec. 26, 2013 (JP) ..... 2013-270273

(51) Int. Cl.
*G03G 15/00* (2006.01)
*G03G 15/01* (2006.01)

(52) U.S. Cl.
CPC ..... *G03G 15/6585* (2013.01); *G03G 15/0105* (2013.01); *G03G 15/657* (2013.01)

(58) Field of Classification Search
CPC ..... G03G 15/6585; G03G 15/0105
See application file for complete search history.

(56) References Cited

U.S. PATENT DOCUMENTS

2007/0127940 A1 6/2007 Zaima
2011/0182607 A1 7/2011 Takemura
2012/0050801 A1 3/2012 Itami
2012/0062956 A1* 3/2012 Kitagawa et al. ..... 358/2.1
2012/0063802 A1* 3/2012 Suzuki et al. ..... 399/82
2012/0237243 A1* 9/2012 Yamamoto et al. ..... 399/67
2012/0237244 A1* 9/2012 Yoshikawa et al. ..... 399/67
2012/0237245 A1* 9/2012 Mitsui et al. ..... 399/69
2012/0237247 A1* 9/2012 Tokushima et al. ..... 399/82
2013/0063740 A1* 3/2013 Mochizuki ..... 358/1.9
2013/0063785 A1* 3/2013 Miyazaki et al. ..... 358/2.1
2013/0250312 A1* 9/2013 Miyazaki ..... 358/1.1
2013/0272765 A1* 10/2013 Habu ..... 399/407
2013/0278943 A1* 10/2013 Kurosawa et al. ..... 358/1.1
2013/0278952 A1* 10/2013 Suzuki et al. ..... 358/1.9
2013/0278953 A1* 10/2013 Yukie et al. ..... 358/1.9
2013/0279958 A1* 10/2013 Yukie et al. ..... 399/341

(Continued)

FOREIGN PATENT DOCUMENTS

JP 2006-168107 6/2006
JP 2007-183593 7/2007

(Continued)

*Primary Examiner* — Rodney Bonnette
(74) *Attorney, Agent, or Firm* — Oblon, McClelland, Maier & Neustadt, L.L.P.

(57) ABSTRACT

A printing control device includes a glossiness target value determining unit that determines a glossiness target value indicating a target of glossiness of image data as a print target, a color separation amount determining unit that determines color separation amounts of a plurality of colored color materials as amounts of the colored color materials to be allocated to the respective colored color materials based on a sum of respective amounts of the colored color materials for the glossiness target value, a color separation processing unit that executes color replacement among a plurality of pieces of colored plane data based on the color separation amounts of the respective colored color materials, and an image data generator that generates the image data based on the pieces of colored plane data on which the color replacement has been executed.

15 Claims, 29 Drawing Sheets

(56) References Cited

U.S. PATENT DOCUMENTS

| | | | | |
|---|---|---|---|---|
| 2015/0062601 | A1* | 3/2015 | Tokushima et al. | 358/1.9 |
| 2015/0063854 | A1* | 3/2015 | Habu | 399/82 |
| 2015/0063886 | A1* | 3/2015 | Awamura et al. | 399/341 |
| 2015/0078769 | A1* | 3/2015 | Kogusuri | 399/39 |
| 2015/0098740 | A1* | 4/2015 | Yukie | 399/341 |
| 2015/0110535 | A1* | 4/2015 | Kogusuri et al. | 399/341 |
| 2015/0138575 | A1* | 5/2015 | Takamizawa et al. | 358/1.9 |
| 2015/0177671 | A1* | 6/2015 | Yoshida et al. | 399/341 |

FOREIGN PATENT DOCUMENTS

| | | |
|---|---|---|
| JP | 2011-043683 | 3/2011 |
| JP | 2011-059445 | 3/2011 |
| JP | 2011-150026 | 8/2011 |
| JP | 2011-150158 | 8/2011 |
| JP | 2011-170125 | 9/2011 |
| JP | 2012-073605 | 4/2012 |

* cited by examiner

FIG.1
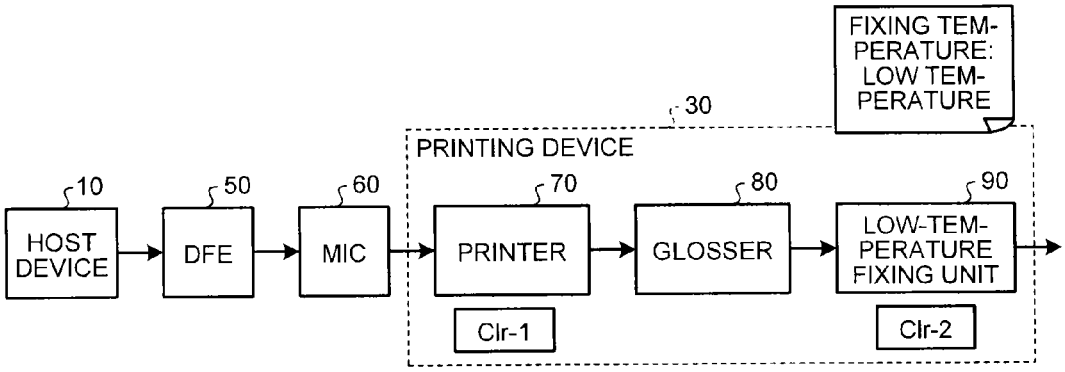
FIG.2
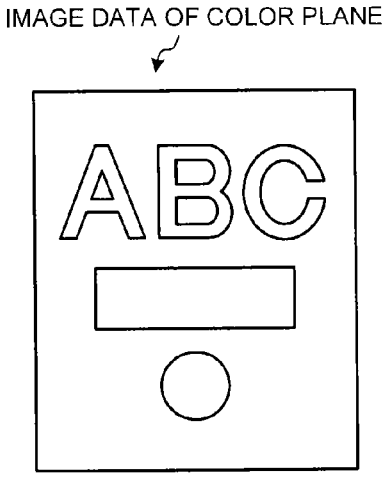
FIG.3
| NAME OF GLOSS CONTROL | GLOSS | DEVIATION |
|---|---|---|
| PREMIUM GLOSS (PG) | Gs≥80 | ΔGs≤10 |
| GLOSS (G) | Gs=Gs (GLOSS) | ΔGs≤10 |
| MATT (M) | Gs=Gs (1C30% HALFTONE DOTS) | ΔGs≤10 |
| PREMIUM MATT (PM) | Gs≤10 | ΔGs≤10 |

FIG.4
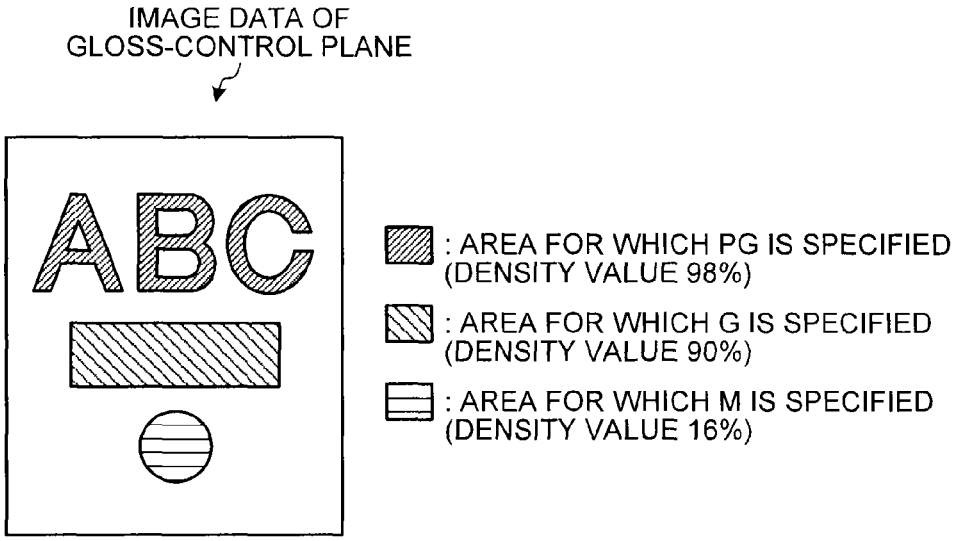
FIG.5
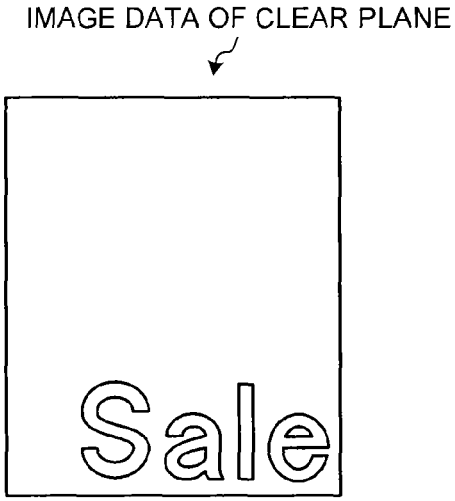
FIG.6
| TYPE OF SURFACE EFFECT SPECIFIED BY USER | DENSITY VALUE OF GLOSS-CONTROL PLANE (%) |
|---|---|
| PG | 98% |
| G | 90% |
| M | 16% |
| PM | 6% |

| DRAWN OBJECT | COORDINATES | DENSITY VALUE |
|---|---|---|
| A, B, C | (x1, y1)−(x2, y2) | 98% |
| (RECTANGULAR FIGURE) | (x3, y3)−(x4, y4) | 90% |
| ... | ... | ... |

FOR COAT SHEET

FIG.15

| DENSITY (%) | DENSITY REPRESENTATIVE VALUE | DENSITY VALUE RANGE | | EFFECT | GLOSSER ON/OFF (ON/OFF INFORMATION) | CLEAR TONER PLANE 1 (PRINTER) | CLEAR TONER PLANE 2 (LOW-TEMERATURE FIXING UNIT) |
|---|---|---|---|---|---|---|---|
| 98% | 250 | 248 | 255 | PREMIUM GLOSS TYPE A | ON | INVERSE MASK A | NO DATA |
| 96% | 245 | 243 | 247 | PREMIUM GLOSS TYPE B | ON | INVERSE MASK B | NO DATA |
| 94% | 240 | 238 | 242 | PREMIUM GLOSS TYPE C | ON | INVERSE MASK C | NO DATA |
| 92% | 235 | 233 | 237 | RESERVED | | | |
| 90% | 230 | 228 | 232 | GLOSS TYPE 1 | OFF | INVERSE MASK 1 | NO DATA |
| 88% | 224 | 222 | 227 | GLOSS TYPE 2 | OFF | INVERSE MASK 2 | NO DATA |
| 86% | 219 | 217 | 221 | GLOSS TYPE 3 | OFF | INVERSE MASK 3 | NO DATA |
| 84% | 214 | 212 | 216 | GLOSS TYPE 4 | OFF | INVERSE MASK 4 | NO DATA |
| 82% | 209 | 207 | 211 | RESERVED | | | |
| 46% | 117 | 115 | 119 | RESERVED | | | |
| 44% | 112 | 110 | 114 | WATERMARK CHARACTER 3 (XXX) | OFF | NO DATA | TILE CHARACTER STRING 3 |
| 42% | 107 | 105 | 109 | WATERMARK CHARACTER 2 (COPYING IS STRICTLY PROHIBITED) | | NO DATA | TILE CHARACTER STRING 2 |
| 40% | 102 | 100 | 104 | WATERMARK CHARACTER 1 (SAMPLE) | | NO DATA | TILE CHARACTER STRING 1 |
| 38% | 97 | 95 | 99 | RESERVED | | | |
| 36% | 92 | 90 | 94 | RESERVED | | | |
| 34% | 87 | 85 | 89 | BACKGROUND PATTERN 3 (XXX) | | NO DATA | TILE BACKGROUND PATTERN 3 |
| 32% | 82 | 80 | 84 | BACKGROUND PATTERN 2 (CHECK) | | NO DATA | TILE BACKGROUND PATTERN 2 |
| 30% | 76 | 74 | 79 | BACKGROUND PATTERN 1 (WAVE) | | NO DATA | TILE BACKGROUND PATTERN 1 |
| 28% | 71 | 69 | 73 | RESERVED | | | |
| 26% | 66 | 64 | 68 | RESERVED | | | |
| 24% | 61 | 59 | 63 | TACTILE PATTERN TYPE 3 (COARSE) | | NO DATA | TILE MESH PATTERN 3 |
| 22% | 56 | 54 | 58 | TACTILE PATTERN TYPE 2 (MIDDLE) | | NO DATA | TILE MESH PATTERN 2 |
| 20% | 51 | 49 | 53 | TACTILE PATTERN TYPE 1 (FINE) | | NO DATA | TILE MESH PATTERN 1 |
| 18% | 46 | 44 | 48 | RESERVED | | | |
| 16% | 41 | 39 | 43 | MATT TYPE 4 | OFF | HALFTONE 4 | NO DATA |
| 14% | 36 | 34 | 38 | MATT TYPE 3 | OFF | HALFTONE 3 | NO DATA |
| 12% | 31 | 29 | 33 | MATT TYPE 2 | OFF | HALFTONE 2 | NO DATA |
| 10% | 25 | 23 | 28 | MATT TYPE 1 | OFF | HALFTONE 1 | NO DATA |
| 8% | 20 | 18 | 22 | RESERVED | | | |
| 6% | 15 | 13 | 17 | PREMIUM MATT TYPE C | ON&OFF | NO DATA | SOLID |
| 4% | 10 | 8 | 12 | PREMIUM MATT TYPE B | ON&OFF | NO DATA | SOLID |
| 2% | 5 | 1 | 7 | PREMIUM MATT TYPE A | ON&OFF | NO DATA | SOLID |
| 0% | 0 | 0 | 0 | NONE | OFF | NO DATA | NO DATA |

FIG.19
| SHEET | GLOSSINESS TARGET VALUE TABLE |
|---|---|
| HIGH-GLOSS SHEET A | 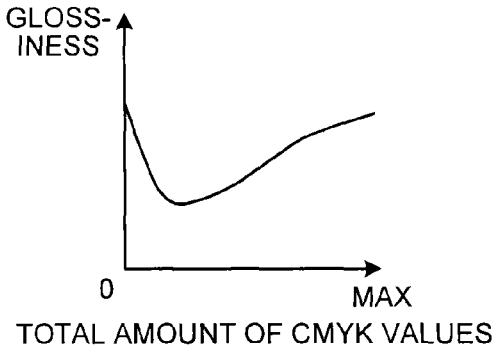  |
| LOW-GLOSS SHEET B | 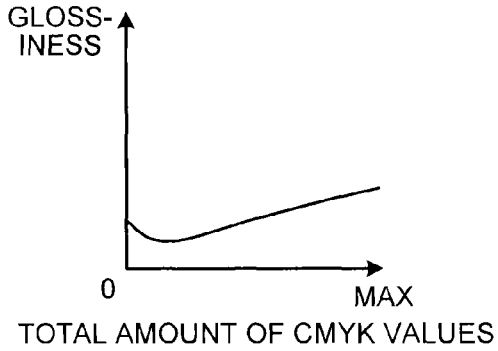  |
| PLAIN SHEET C | 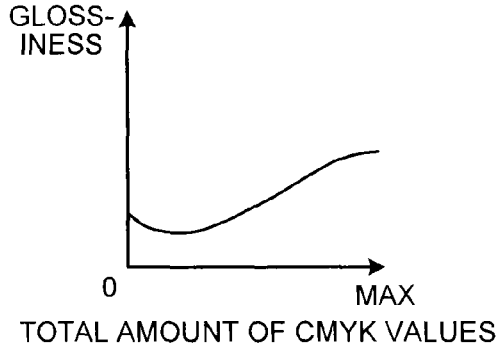  |

FIG.36
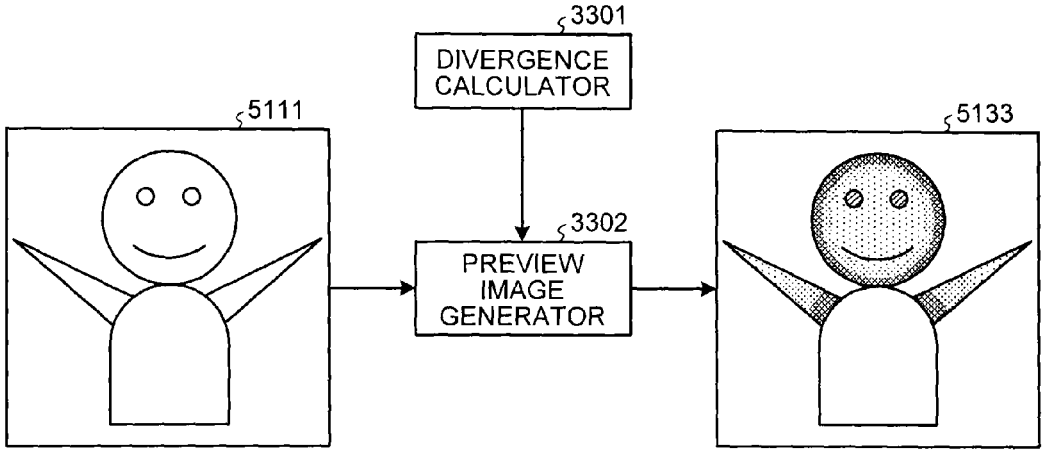
FIG.37
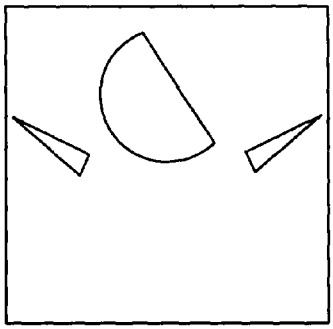
FIG.38
| COLOR TYPE | PIXEL VALUES OF INPUT DATA (CMYK) | DIVERGENCE | FREQUENCY |
|---|---|---|---|
| A | 100, 100, 100, 100 | 4.6 | 1792 |
| B | 100, 0, 100, 100 | 5.1 | 955 |
| C | 100, 0, 0, 90 | 3.6 | 742 |
| D | 100, 0, 100, 0 | 4.2 | 145 |

DEVICE, SYSTEM, METHOD, AND RECORDING MEDIUM HAVING COMPUTER PROGRAM FOR CONTROLLING PRINTING

CROSS-REFERENCE TO RELATED APPLICATIONS

The present application claims priority to and incorporates by reference the entire contents of Japanese Patent Application No. 2013-270273 filed in Japan on Dec. 26, 2013.

BACKGROUND OF THE INVENTION

1. Field of the Invention

The present invention relates to a device, a system, a method, and a computer-readable recording medium having a computer program for controlling printing.

2. Description of the Related Art

Conventionally, there have been developed image forming apparatuses provided with a clear toner, which is a colorless toner including no color material in addition to four colored toners of cyan (C), magenta (M), yellow (Y), and black (K). A toner image formed with such a clear toner is fixed on a transfer sheet, on which an image is formed with CMYK colored toners. As a result, a visual effect and a tactile effect (referred to as a surface effect) are produced on the surface of the transfer sheet. The surface effect to be produced differs depending on the type of the toner image formed with the clear toner and the way to fix the toner image. Some surface effects simply provide gloss, whereas some surface effects suppress gloss. Other examples of the surface effects may include: a surface effect applied not to the entire surface but to a part thereof; a surface effect that forms a texture and a watermark with a clear toner; a surface effect that provides surface protection; and a surface effect produced by a dedicated post-processing device, such as a glosser and a low-temperature fixing device, performing post-processing besides by fixing control. In recent years, as disclosed in Japanese Patent Application Laid-open No. 2011-150158, for example, a technique of providing gloss by causing a clear toner to adhere to only a desired portion on a part of a surface has been developed.

Furthermore, as disclosed in Japanese Patent Application Laid-open No. 2011-43683, for example, gloss is influenced by surface roughness of an image formed on a recording medium, that is, is influenced by surface irregularities that are generated by CMYK toners. This means that the degree of gloss is not always increased in accordance with a density of a clear toner simply.

That is to say, smoothness of a surface of an image is required to be controlled in order to provide gloss. For controlling the smoothness, image data of a clear toner plane as image data for forming a toner image with a clear toner needs to be created in accordance with density values of CMYK for pixels to which the clear toner is made to adhere, presence or absence of a post-processing device that is connected to an image formation apparatus, and a type thereof. In addition, contents of the image data of the clear toner plane, the number of pieces of image data of the clear toner plane that are created, control of a printer, control of the post-processing device, and the like are needed to be adjusted finely. As general characteristics of glossiness, glossiness tends to be high on white paper, particularly, solid portions and glossiness tends to be low on portions with intermediate colors. Based on the characteristics, processing of providing even glossiness on the entire surface by controlling an amount of the clear toner so as to obtain target glossiness on the solid portions has been considered to be needed and already known.

There is the following conventional method of adjusting the glossiness as disclosed in Japanese Patent Application Laid-open No. 2007-186593. That is, gloss difference is eliminated by controlling an amount of the clear toner itself. The method, however, has a problem that the clear toner is more expensive than colored toners and print cost is increased.

Furthermore, a method in which a feeling of strangeness of the gloss difference is reduced by limiting portions on which the clear toner is used has been also proposed as disclosed in Japanese Patent Application Laid-open No. 2006-168107. The method can reduce the cost but has a problem that generation of irregularities on a printed material as a result has to be allowed.

In view of the above-mentioned circumferences, there is a need to provide a device, a system, a method, and a computer-readable recording medium having a computer program for controlling printing that are capable of improving print quality by adjusting amounts of colored color materials and eliminating gloss difference on an entire surface, and reducing cost of a clear color material.

SUMMARY OF THE INVENTION

It is an object of the present invention to at least partially solve the problems in the conventional technology.

According to the present invention, there is provided a printing control device comprising: a glossiness target value determining unit that determines a glossiness target value indicating a target of glossiness of image data as a print target; a color separation amount determining unit that determines color separation amounts of a plurality of colored color materials as amounts of the colored color materials to be allocated to the respective colored color materials based on a sum of respective amounts of the colored color materials for the glossiness target value; a color separation processing unit that executes color replacement among a plurality of pieces of colored plane data based on the color separation amounts of the respective colored color materials; and an image data generator that generates the image data based on the pieces of colored plane data on which the color replacement has been executed.

The present invention also provides a printing control system that generates image data and includes the printing control apparatus mentioned above.

The present invention also provides a printing control method comprising: determining a glossiness target value indicating a target of glossiness of image data as a print target; determining color separation amounts of a plurality of colored color materials as amounts of the colored color materials to be allocated to the respective colored color materials based on a sum of respective amounts of the colored color materials for the glossiness target value; executing color replacement among a plurality of pieces of colored plane data based on the color separation amounts of the respective colored color materials; and generating the image data based on the pieces of colored plane data on which color replacement has been executed.

The present invention also provides a non-transitory computer-readable recording medium that contains a computer program that causes a computer to execute: determining a glossiness target value indicating a target of glossiness of image data as a print target; determining color separation amounts of a plurality of colored color materials as amounts of the colored color materials to be allocated to the respective colored color materials based on a sum of respective amounts of the colored color materials for the glossiness target value; executing color replacement among a plurality of pieces of colored plane data based on the color separation amounts of the respective colored color materials; and generating the image data based on the pieces of colored plane data on which color replacement has been executed.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 1 is an exemplary diagram illustrating the configuration of an image formation system according to a first embodiment of the present invention;

FIG. 2 is a view illustrating an example of image data of a colored plane in the first embodiment;

FIG. 3 is an exemplary table illustrating types of surface effects related to the presence or absence of gloss in the first embodiment;

FIG. 4 is a view illustrating image data of a gloss-control plane as an image in the first embodiment;

FIG. 5 is a view illustrating an example of image data of a clear plane in the first embodiment;

FIG. 6 is a view illustrating an example of a density value selection table in the first embodiment;

FIG. 15 is an exemplary table illustrating a data structure of a surface effect selection table in the first embodiment;

FIG. 19 is an exemplary table illustrating glossiness target values corresponding to sheet types according to a second embodiment of the present invention;

FIG. 36 is an exemplary diagram illustrating the procedure of generation of a preview image in the eighth embodiment;

FIG. 37 is a view illustrating another display example of the preview image in the eighth embodiment;

FIG. 38 is a table illustrating a list of pixel values of pixels having divergences of equal to or higher than a certain value and frequencies according to a first modification of the embodiment;

DETAILED DESCRIPTION OF THE PREFERRED EMBODIMENTS

Figures 7, 8:
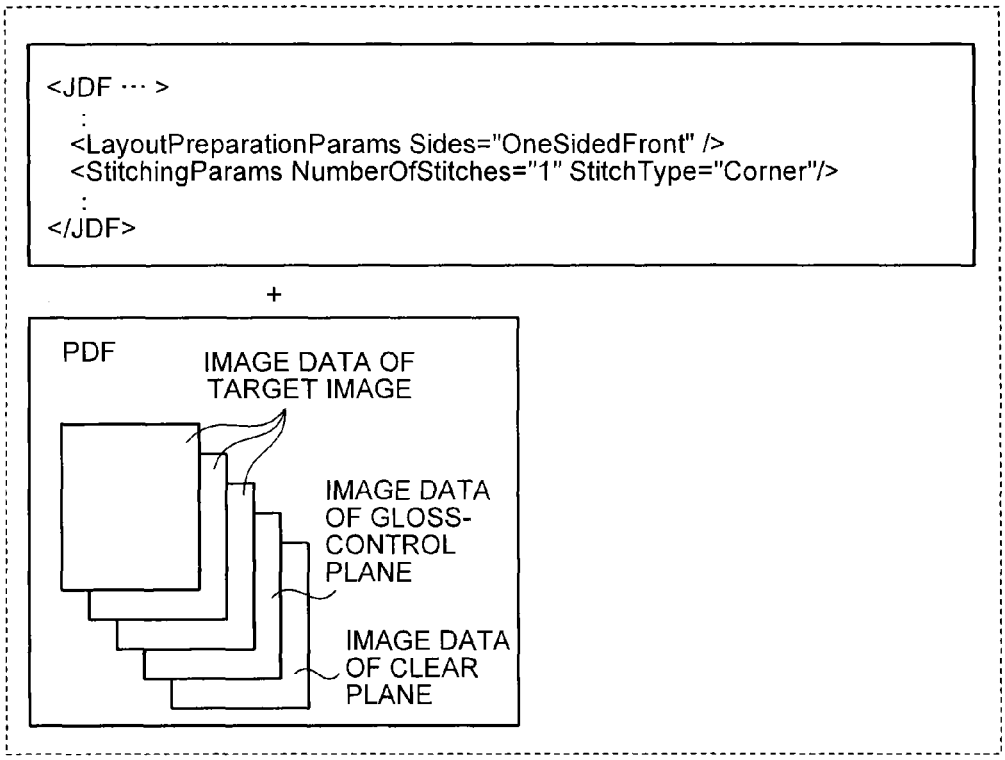
FIG. 7 is a table illustrating a correspondence relation among drawn objects, coordinates, and density values in the image data of the gloss-control plane in the first embodiment.
FIG. 8 is a schematic plan view conceptually illustrating an example of the structure of print data in the first embodiment.

Exemplary embodiments of a device, a system, a method, and a computer-readable recording medium having a computer program for controlling printing are described below in greater detail with reference to the accompanying drawings.

First Embodiment

A configuration of an image forming system according to a first embodiment of the present invention will be described with reference to FIG. 1. The image forming system according to the present embodiment includes a printer control device (digital front end: DFE) 50 (hereinafter, referred to as a "DFE 50"), an interface controller (mechanism I/F controller: MIC) 60 (hereinafter, referred to as an "MIC 60"), a printer 70, and a glosser 80 and a low-temperature fixing unit 90 serving as post-processing devices connected in series. The DFE 50 communicates with the printer 70 via the MIC 60 and controls formation of an image in the printer 70. Furthermore, the DFE 50 is connected to a host device 10, such as a personal computer (PC), and receives image data from the host device 10. The DFE 50 uses the image data to generate image data used for forming toner images corresponding to CMYK toners and a clear toner by the printer 70. The DFE 50 then transmits the image data thus generated to the printer 70 via the MIC 60. The printer 70 is provided with at least CMYK toners and a clear toner. The printer 70 is further provided with an image forming unit including a photosensitive element, a charger, a developing unit, and a photosensitive-element cleaning unit, an exposing unit, and a fixing unit for each toner.

The printer 70, the glosser 80, and the low-temperature fixing unit 90 constitute a printing device 30.

The clear toner is a transparent (colorless) toner including no color material. Being transparent (colorless) means that the transmittance is equal to or larger than 70%, for example.

The printer 70 outputs a light beam from the exposing unit correspondingly to image data transmitted from the DFE 50 via the MIC 60 to form a toner image corresponding to each toner on the photosensitive element. The printer 70 then transfers the toner image onto a sheet serving as a recording medium and fixes the toner image thereon at temperature within a predetermined range (normal temperature) and pressure by the fixing unit. Thus, an image is formed on the sheet. The configuration of the printer 70 has been well known and detail description thereof is omitted here. The sheet is given just as an example of the recording medium, and the recording medium is not limited thereto. The recording medium may be a piece of synthetic paper or a piece of plastic paper, for example.

The glosser 80 is controlled to be turned ON or OFF in accordance with ON-OFF information specified by the DFE 50. If the glosser 80 is turned ON, the glosser 80 presses an image formed on a sheet by the printer 70 at high temperature and high pressure. Subsequently, the glosser 80 cools the sheet on which the image is formed and removes the sheet from its main body. This operation evenly compresses the total amount of adhered toners on pixels to which a toner of equal to or larger than a predetermined amount is adhered in the whole image formed on the sheet. The low-temperature fixing unit 90 is provided with an image forming unit including a photosensitive element for a clear toner, a charger, a developing unit, and a photosensitive-element cleaning unit, an exposing unit, and a fixing unit for fixing the clear toner, and receives image data of clear toner plane, which will be described later, generated by the DFE 50 (hereinafter, referred to as clear toner plane data). When the DFE 50 generates the clear toner plane data to be used by the low-temperature fixing unit 90, the low-temperature fixing unit 90 forms a toner image with the clear toner using the clear toner plane data, superimposes the toner image on a sheet pressed by the glosser 80, and fixes it onto the sheet by heating or pressing that is more moderate than usual by the fixing unit.

The image data (document data) received from the host device 10 will now be described. In the host device 10, image data is generated by an image processing application installed in advance and is transmitted to the DFE 50. Such an image processing application can deal with image data of a specific color plane in contrast to image data that specifies a value of density (referred to as a density value) of each color in each color plane, such as an RGB plane and a CMYK plane, for each pixel. The specific color plane is image data used for adhering a toner and an ink of a specific color, such as white, gold, and silver, in addition to basic colors, such as CMYK and RGB. The specific color plane is data used by a printer provided with a toner and an ink of such a specific color. To improve the color reproducibility, R may be added to the basic colors of CMYK or Y may be added to the basic colors of RGB in the specific color plane. Typically, a clear toner has been considered as one of the specific colors.

In the present embodiment, the clear toner serving as a specific color is used to form a surface effect, which is a visual or tactile effect to be applied to a sheet, and to form a transparent image, such as a watermark and a texture, other than the surface effect described above.

The image processing application of the host device 10 generates, for input image data, image data of a gloss-control plane (hereinafter, also referred to as "gloss-control plane data" in some cases) and/or image data of a clear plane (hereinafter, also referred to as "clear plane data" in some cases) as (pieces of) image data of the specific color plane with specification by a user, in addition to image data of a colored plane (hereinafter, also referred to as "colored plane data" in some cases).

The data of the color plane is image data that specifies the density value of a color of RGB and CMYK for each pixel, for example. In the data of the color plane, one pixel is represented by 8-bits in accordance with the user's specification of a color. FIG. 2 is a view for explaining an example of the data of the color plane. In FIG. 2, a density value corresponding to a color specified by the user via the image processing application is defined for each drawn object, such as "A", "B", and "C".

The data of the gloss-control plane is image data used to perform control for adhering the clear toner correspondingly to a surface effect, which is a visual or tactile effect applied to a sheet, and specifies an area to which the surface effect is to be applied and the type of the surface effect.

Similarly to the color plane of RGB and CMYK, for example, each pixel in the data of the gloss-control plane is represented by 8-bits with a density value ranging from "0" to "255". The density values are associated with the types of surface effects (the density values may be represented by 16-bits or 32-bits or by 0 to 100%). The same value is set for areas to which the same surface effect is desired to be applied regardless of the density of the clear toner to be actually adhered. Therefore, even if there is no data indicating the areas, the areas can be readily specified from the image data as needed. In other words, the gloss-control plane indicates the type of a surface effect and the area to which the surface effect is to be applied (data indicating the area may be provided separately).

The host device 10 sets the type of a surface effect for a drawn object specified by the user via the image processing application as a density value serving as a gloss-control value for each drawn object, thereby generating data of the gloss-control plane in a vector format.

Each pixel constituting the data of the gloss-control plane corresponds to each pixel in the data of the colored plane. The density value of each pixel corresponds to the pixel value in each image data. Both the data of the colored plane and the data of the gloss-control plane are formed in page units.

The types of surface effects are roughly classified into a surface effect related to the presence of gloss, surface protection, a watermark indicating information, and a texture, for example. The surface effects related to the presence of gloss are roughly classified into four as illustrated in FIG. 3. The four types of surface effects are premium gloss (PG), gloss (G), matt (M), and premium matt (PM) in descending order of degrees of gloss (glossiness), for example. Hereinafter, premium gloss, gloss, matt, and premium matt may be referred to as "PG", "G", "M", and "PM", respectively.

Premium gloss and gloss provide a higher gloss, whereas matt and premium matt suppress gloss. In particular, premium matt provides glossiness lower than that of plain paper. In FIG. 3, premium gloss indicates glossiness Gs of equal to or higher than 80, gloss indicates solid glossiness in a primary color or a secondary color, matt indicates glossiness in a primary color and halftone dots of 30%, and premium matt indicates glossiness of equal to or lower than 10. The deviation in the glossiness is represented by AGs and is equal to or smaller than 10. For these types of surface effects, a higher density value is associated with a surface effect that provides a higher gloss, whereas a lower density value is associated with a surface effect that suppresses gloss. A density value in the middle thereof is associated with a surface effect, such as a watermark and a texture. Examples of the watermark may include a character and a background pattern. The texture is formed of characters and patterns and can produce a tactile effect besides a visual effect. A pattern of a stained glass can be formed with the clear toner, for example. Premium gloss and gloss also serve as surface protection. The user specifies the area to which the surface effect is to be applied in an image represented by image data to be processed and the type of the surface effect to be applied to the area via the image processing application. The host device 10 that exerts the image processing application sets a density value corresponding to the surface effect specified by the user for the drawn object corresponding to the area specified by the user, thereby generating data of the gloss-control plane. The correspondence relation between the density values and the types of surface effects will be described later in detail.

FIG. 4 is a view for explaining an example of the data of the gloss-control plane. In the example of the gloss-control plane in FIG. 4, the user applies the surface effect "premium gloss (PG)" to a drawn object of "ABC", applies the surface effect "gloss (G)" to a drawn object of "(a rectangular figure)", and applies the surface effect "matt (M)" to a drawn object of "(a circular figure)". The density value set for each surface effect is a density value defined correspondingly to the type of each surface effect in a density value selection table (refer to FIG. 6), which will be described later.

The data of the clear plane is image data specifying a transparent image, such as a watermark and a texture, other than the surface effects described above. FIG. 5 is a view for explaining an example of the data of the clear plane. In the example of FIG. 5, the user specifies a watermark "Sale".

As described above, the data of the gloss-control plane and the data of the clear plane, which is image data of the specific color plane, is generated as planes different from that of the image data of the color plane by the image processing application of the host device 10. The data of the color plane, the data of the gloss-control plane, and the data of the clear plane are generated in a portable document format (PDF). These pieces of image data of the planes in the PDF are integrated and generated as document data. The data format of the image data of each plane is not limited to the PDF and may be an arbitrary format.

The image processing application of the host device 10 converts a type of the surface effect specified by the user to a density value so as to generate the gloss-control plane data. The conversion is performed by referring to the density value selection table previously stored in a storage unit of the host device 10. The density value selection table is table data in which types of surface effects and density values of the gloss-control plane are made to correspond to each other. FIG. 6 is a schematic of an example of the density value selection table. In the example of FIG. 6, a density value of the gloss-control plane corresponding to an area to which the user has specified to apply "PG" (premium gloss) is a pixel value equivalent to "98%", a density value of the gloss-control plane corresponding to an area to which the user has specified to apply "G" (gloss) is a pixel value equivalent to "90%", a density value of the gloss-control plane corresponding to an area to which the user has specified to apply "M" (matt) is a pixel value equivalent to "16%", and a density value of the gloss-control plane corresponding to an area to which the user has specified to apply "PM" (premium matt) is a pixel value equivalent to "6%".

Figure 11:
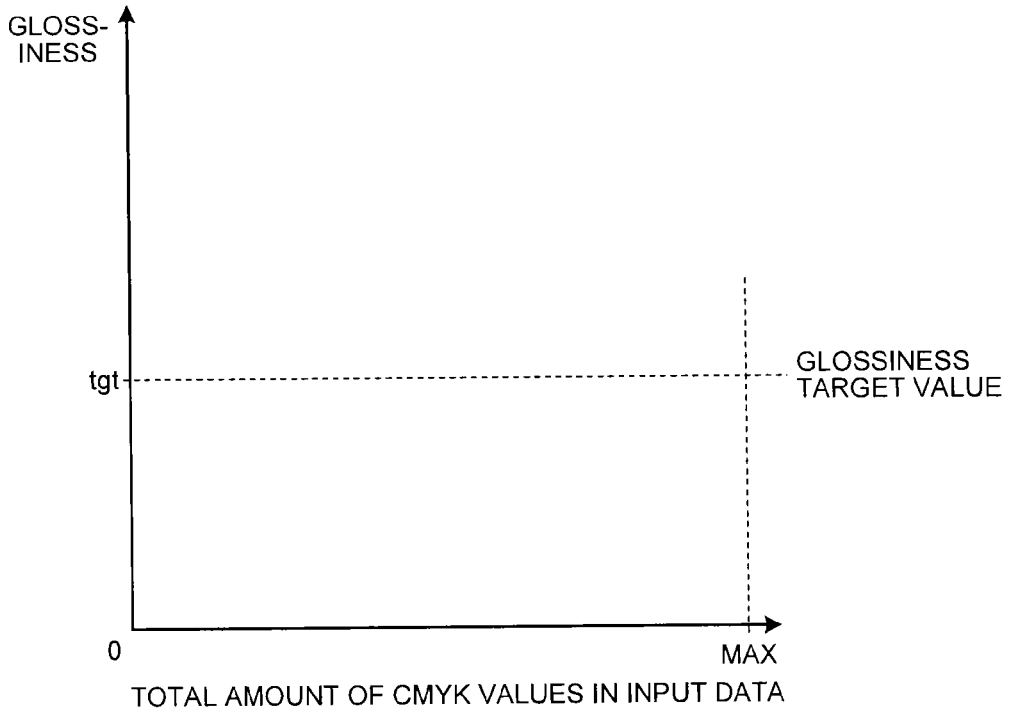
FIG. 11 is an exemplary graph conceptually illustrating a glossiness target value table in the first embodiment.

The density value selection table has pieces of data that are the same as those in a surface effect selection table (which will be described later) stored in the DFE 50. A controller (not illustrated) of the host device 10 acquires the surface effect selection table at a predetermined timing, generates (copies) the density value selection table from the acquired surface effect selection table, and stores it in the storage unit. Although FIG. 6 illustrates an example of the density value selection table in a simplified manner, the density value selection table is the same as the surface effect selection table as illustrated in FIG. 11 actually. The surface effect selection table may be stored in a storage server (cloud) on a network, such as the Internet. In this case, the control unit of the host device 10 acquires the surface effect selection table from the server and generates (copies) the density value selection table from the surface effect selection table thus acquired. The surface effect selection table stored in the DFE 50 needs to be the same as the surface effect selection table stored in the storage unit of the host device 10.

To be specific, the image processing application of the host device 10 generates the gloss-control plane data by setting a density value (gloss control value) of a drawn object to which the user has specified to apply a predetermined surface effect to a value corresponding to the type of the surface effect with reference to the density value selection table as illustrated in FIG. 6. An assumption is made that the user specifies to apply "PG" to the area displayed as "ABC", apply "G" to the area of the rectangular figure, and apply "M" to the area of the circular figure among the target images serving as the data of the color plane illustrated in FIG. 2, for example. In this case, the host device 10 sets the density value of the drawn object ("ABC") to which the user has specified to apply "PG" to a pixel value equivalent to "98%", sets the density value of the drawn object ("rectangular figure") to which the user has specified to apply "G" to a pixel value equivalent to "90%", and sets the density value of the drawn object ("circular figure") to which the user has specified to apply "M" to a pixel value equivalent to "16%" so as to generate the gloss-control plane data. The data of the gloss-control plane generated by the host device 10 is data in a vector format represented as a set of drawn objects indicating coordinates of points, parameters of equations of lines and planes connecting the points, fill, and special effects, for example. FIG. 4 is a view illustrating the gloss-control plane data as an image. FIG. 7 is a table illustrating a correspondence relation among the drawn objects, coordinates, and the density values in the gloss-control plane data as illustrated in FIG. 4.

The host device 10 generates document data by integrating the image data of the gloss-control plane, the image data of the target image (image data of the color plane), and the image data of the clear plane and transmits the document data to a print data generating unit (not illustrated).

The host device 10 generates print data based on the document data. The print data includes the image data of the target image (data of the color plane), the data of the gloss-control plane, the data of the clear plane, and a job command, such as setting of a printer, setting for intensive printing, and setting for duplex printing, issued to the printer. FIG. 8 is a conceptual schematic of an exemplary structure of the print data. While job definition format (JDF) is used as a job command in the example of FIG. 8, the job command is not limited thereto. The JDF illustrated in FIG. 8 is a command for specifying "single-sided printing and stapling" as the setting for intensive printing. The print data may be converted into a page description language (PDL), such as PostScript, or may remain in the PDF as long as the DFE 50 is compatible with the PDF.

Figure 9:
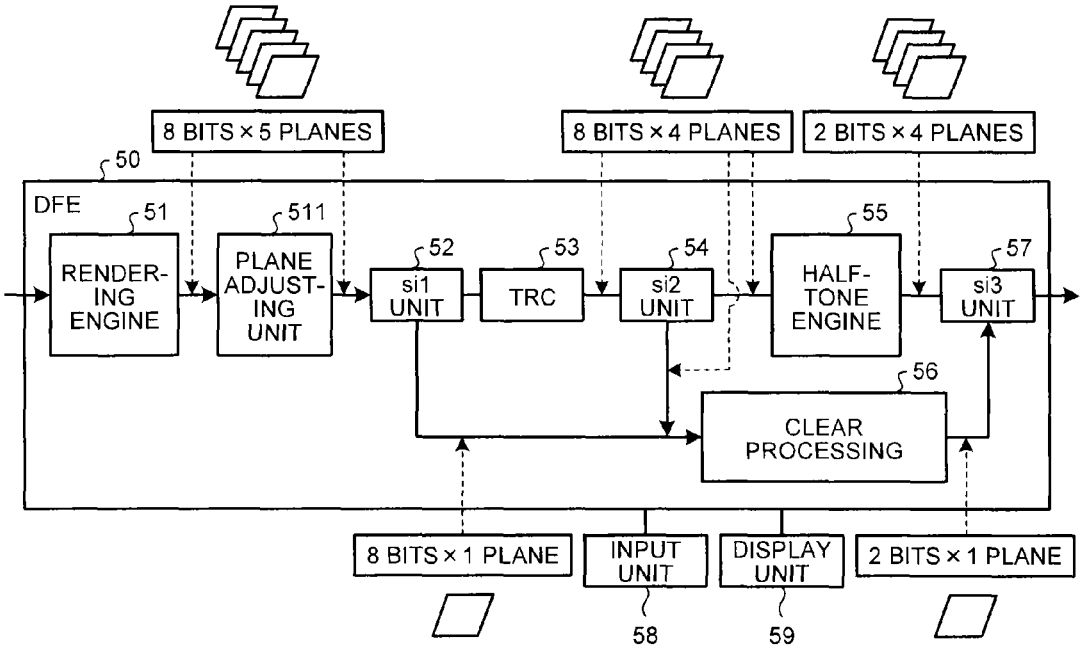
FIG. 9 is an exemplary diagram illustrating the functional configuration of a DFE in the first embodiment.

The functional configuration of the DFE 50 will now be described. As illustrated in FIG. 9, the DFE 50 includes a rendering engine 51, a plane adjusting unit 511, a si1 unit 52, a tone reproduction curve (TRC) 53, a si2 unit 54, a halftone engine 55, a clear processing 56, a si3 unit 57, an input unit 58, and a display unit 59. The rendering engine 51, the si1 unit 52, the TRC 53, the si2 unit 54, the halftone engine 55, the clear processing 56, and the si3 unit 57 are executed by a control unit of the DFE 50 executing various computer programs stored in a main memory or an auxiliary memory. The si1 unit 52, the si2 unit 54, and the si3 unit 57 have a function to separate image data and a function to integrate image data.

Although description is made using the case where print data is formed by the colored plane data and the gloss-control plane data without containing the clear plane data as an example hereinafter, the print data may contain the clear plane data.

The input unit 58 is an input device such as a keyboard and a mouse. The display unit 59 is a display device such as a display.

The print data (print data as illustrated in FIG. 8) transmitted from the host device 10 is input to the rendering engine 51. The rendering engine 51 interprets the language of the image data thus received to convert the image data expressed in a vector format into image data expressed in a raster format and convert a color space expressed in an RGB format or the like into a color space in a CMYK format. Then, the rendering engine 51 outputs pieces of 8-bit colored plane data of CMYK and 8-bit gloss-control plane data, as converted pieces of data, to the plane adjusting unit 511.

The plane adjusting unit 511 receives the pieces of 8-bit colored plane data of CMYK and the 8-bit gloss-control plane data, executes data adjustment among the respective planes in order to correct unevenness of the glossiness, and outputs the pieces of 8-bit colored plane data of CMYK and the 8-bit gloss-control plane data again. Details of the plane adjusting unit 511 will be described later.

The si1 unit 52 outputs the pieces of 8-bit colored plane data of CMYK to the TRC 53 and outputs the 8-bit data of gloss-control plane to the clear processing 56. The DFE 50 converts data of the gloss-control plane in a vector format received from the host device 10 into to data of gloss-control plane in a raster format. As a result, the DFE 50 sets the type of the surface effect for the drawn object specified by the user via the image processing application as a density value in pixel units, thereby outputting data of the gloss-control plane.

The TRC 53 receives the pieces of 8-bit image data of CMYK via the si1 unit 52. The TRC 53 performs gamma correction on the image data thus received using a gamma curve of 1D LUT generated by calibration. Examples of the data processing include control on the total amount of toner besides the gamma correction. The total amount control is processing for limiting the pieces of 8-bit colored plane data of CMYK on which the gamma correction is performed for the reason of limits on the amount of toner capable of being supplied by the printer 70 to one pixel on a recording medium. If an image is printed in disregard of the total amount control, the image quality deteriorates because of poor transfer and poor fixing. In the present embodiment, the explanation is made of the related gamma correction alone.

The si2 unit 54 outputs the pieces of 8-bit colored plane data of CMYK on which the gamma correction is performed by the TRC 53 to the clear processing 56 as data used for generating an inverse mask (which will be described later). The halftone engine 55 receives the pieces of 8-bit colored plane data of CMYK on which the gamma correction is performed via the si2 unit 54. To output the pieces of image data thus received to the printer 70, the halftone engine 55 performs halftone processing for converting the pieces of image data into pieces of 2-bit colored plane data of CMYK, for example. The halftone engine 55 then outputs the pieces of 2-bit colored plane data of CMYK obtained by performing the halftone processing. The 2-bit data format is given just as an example, and the data format is not limited thereto.

Hereinafter, an example where allocation of the colored color materials is adjusted for portions having glossiness diverged from target glossiness.

Figure 10:
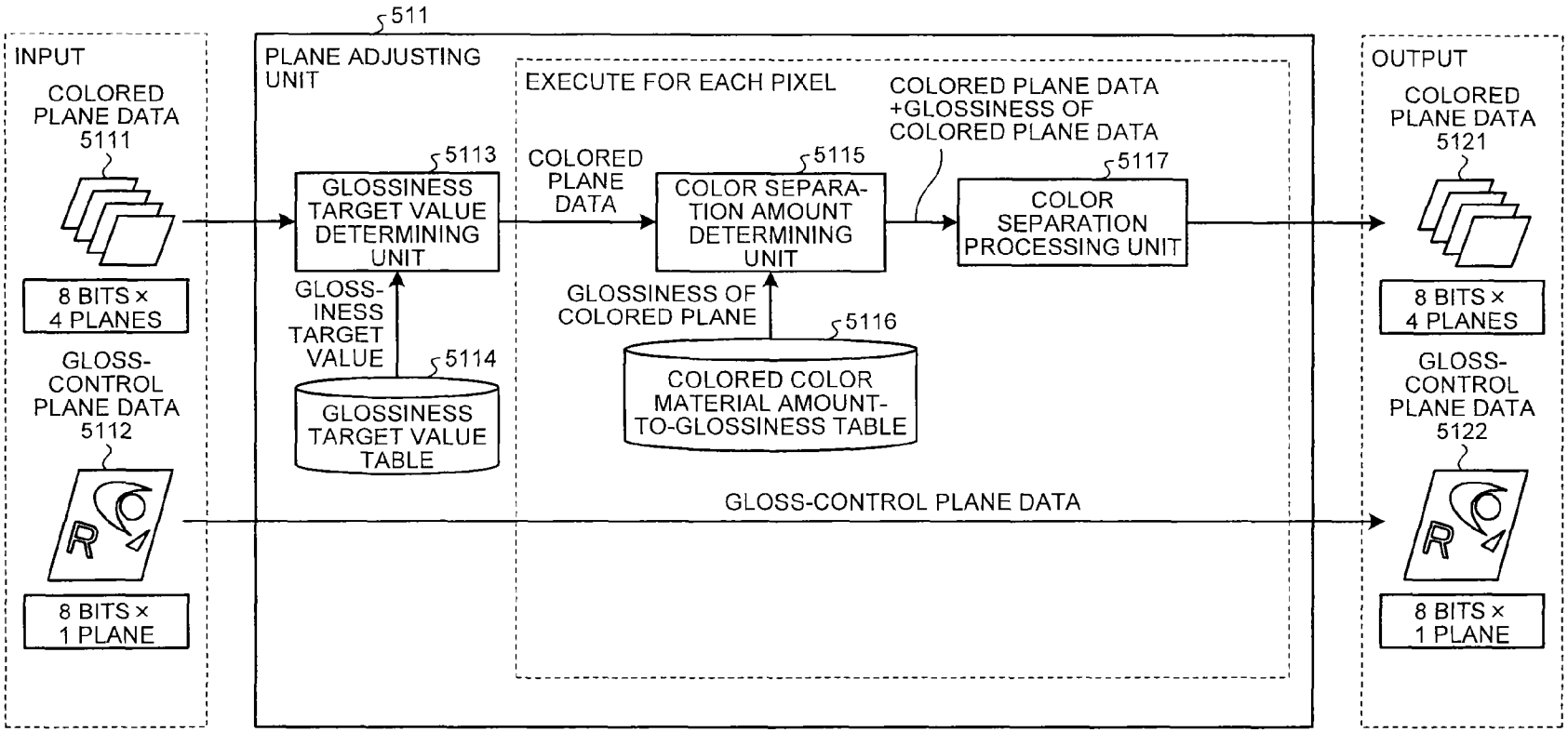
FIG. 10 is a diagram illustrating the configuration of a plane adjusting unit in the first embodiment.

FIG. 10 is a block diagram mainly illustrating the functional configuration of the plane adjusting unit 511 in the first embodiment. Pieces of colored plane data 5111 (8 bits×4 planes) and gloss-control plane data 5112 (8 bits×1 plane) are input to the plane adjusting unit 511. Pieces of colored plane data 5121 are provided as outputs from the plane adjusting unit 511. Although gloss-control plane data 5122 is also provided as output from the plane adjusting unit 511, adjustment related to the gloss-control plane data is not executed in the first embodiment and data same as the input data is output as the gloss-control plane data 5122 as a result.

It should be noted that a "color material" in the following description is not limited to toner. For example, the "color material" may be ink.

As illustrated in FIG. 10, the plane adjusting unit 511 mainly includes a glossiness target value determining unit 5113, a glossiness target value table 5114 that the glossiness target value determining unit 5113 refers, a color separation amount determining unit 5115, a colored color material amount-to-glossiness table 5116 that the color separation amount determining unit 5115 refers, and a color separation processing unit 5117. With this configuration, the color separation processing is executed finally, thereby adjusting amounts of the colored color materials.

The glossiness target value table 5114 is data defining a glossiness target value as target glossiness. The glossiness target value determining unit 5113 determines the glossiness target value by referring to the glossiness target value table 5114. That is to say, in the first embodiment, the glossiness target value determining unit 5113 reads the glossiness target value defined in the glossiness target value table 5114 and determines the read glossiness target value as the glossiness target value.

FIG. 11 is an exemplary graph conceptually illustrating the above-mentioned glossiness target value table 5114. The graph as illustrated in FIG. 11 indicates that the glossiness target value is always constant for any total amount of the CMYK values. It should be noted that the glossiness target value table 5114 is not limited to this example. For example, the glossiness target value table 5114 may be configured such that the target value is set to be relatively higher for low density portions and high density portions than that for middle density portions.

Figure 12:
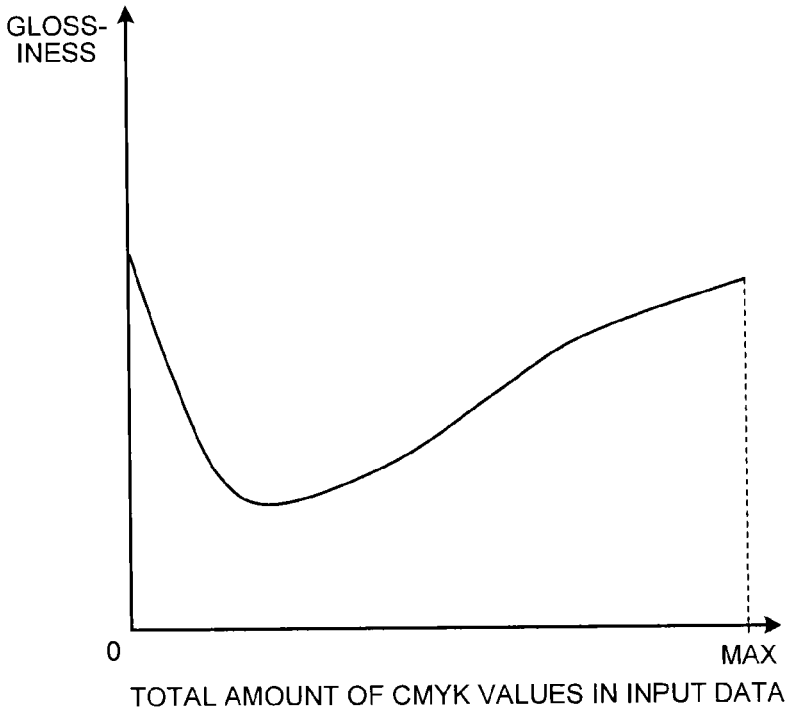
FIG. 12 is an exemplary graph conceptually illustrating a colored color material amount-to-glossiness table in the first embodiment.

The colored color material amount-to-glossiness table 5116 is table data defining glossiness relative to the total amount of the colored color materials. FIG. 12 is a graph conceptually illustrating an example of the colored color material amount-to-glossiness table 5116. In the example of FIG. 12, the colored color material amount-to-glossiness table 5116 is a table having characteristics that "the glossiness is high on portions having small total amounts of the colored color materials and portions having large total amounts of the colored color materials whereas the glossiness is low on portions with intermediate colors". It should be noted that the colored color material amount-to-glossiness table 5116 is not limited thereto. For example, the colored color material amount-to-glossiness table 5116 can be also configured such that "as the total amount of the colored color materials is smaller, the glossiness is higher, whereas as the total amount of the colored color materials is larger, the glossiness is lower".

The color separation amount determining unit 5115 acquires glossiness corresponding to the total amount of the CMYK values for each of the pixels of the pieces of colored plane data 5111 as image data as a print target by referring to the colored color material amount-to-glossiness table 5116. Then, the color separation amount determining unit 5115 calculates difference between the glossiness acquired from the colored color material amount-to-glossiness table 5116 and the glossiness target value determined by the glossiness target value determining unit 5113, determines the degree of generated unevenness of the glossiness based on the difference, and determines the degree of the color separation processing to be executed, that is, color separation amounts. The color separation amounts are determined as follows.

Figure 13A:
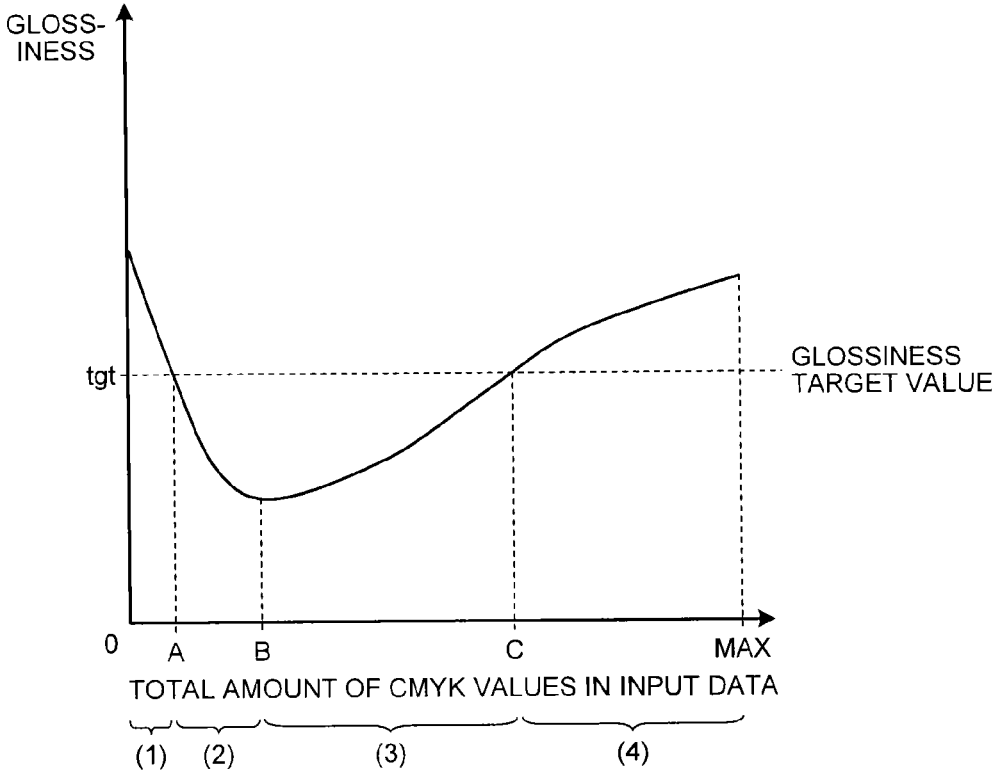
FIG. 13A is an exemplary graph conceptually illustrating correction of unevenness of glossiness in the first embodiment.

FIG. 13A is an exemplary graph conceptually illustrating correction of unevenness of the glossiness in the first embodiment. In FIG. 13A, a glossiness target value is assumed to be Tgt, CMYK total amount values on input data at two points as intersections between Tgt and the graph of the colored color material amount-to-glossiness table 5116 are assumed to be A and C, a CMYK total amount value at a point at which the glossiness is minimum is assumed to be B, a minimum value of the CMYK total amount value is assumed to be 0, and a maximum value thereof is assumed to be Max. Color replacement between the CMY values and the K value is executed while setting the glossiness Tgt to the glossiness target value in respective sections of the total amount value.

In a section 0 to A of the total amount value, K is replaced by CMY such that the CMYK total amount value is closer to A and the total amount value is increased so as to try to provide the glossiness Tgt. In a section A to B of the total amount value, CMY is replaced by K such that the total amount value is closer to A and the total amount value is decreased so as to try to provide the glossiness Tgt. In a section B to C of the total amount value, K is replaced by CMY such that the CMYK total amount value is closer to C and the total amount value is increased so as to try to provide the glossiness Tgt. In a section C to Max of the total amount value, CMY is replaced by K such that the total amount value is closer to C and the total amount value is decreased so as to try to provide the glossiness Tgt.

Figure 13B:
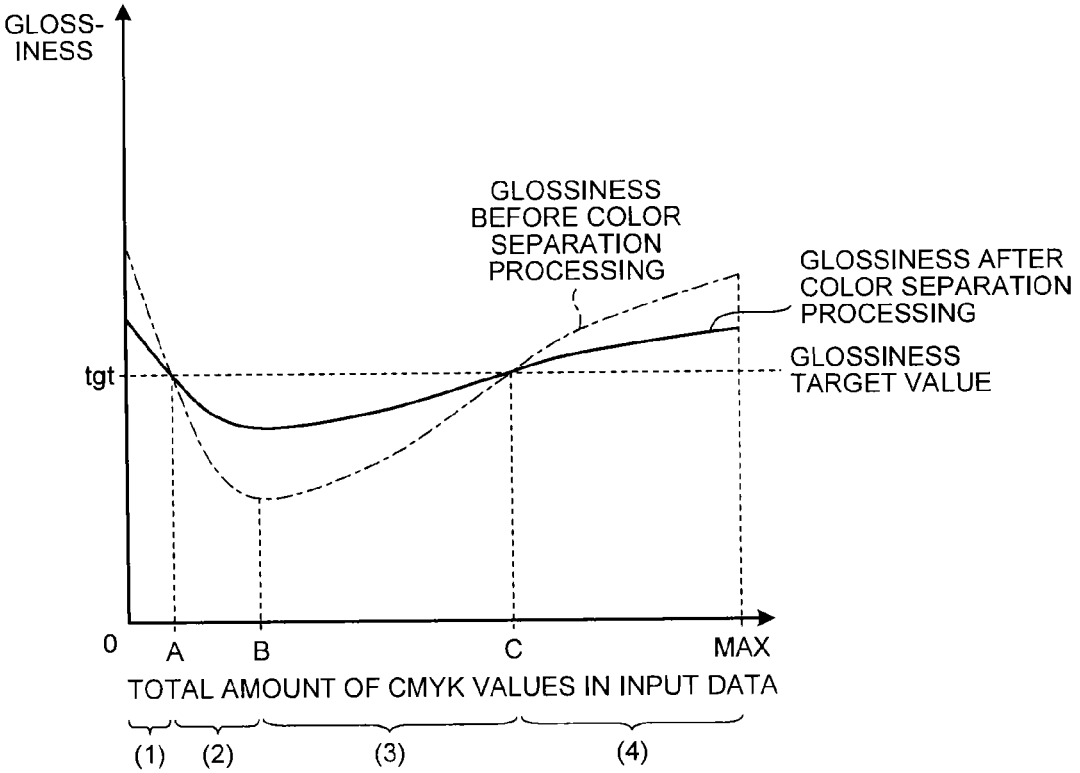
FIG. 13B is a graph illustrating glossiness before color separation processing, glossiness after the color separation processing, and a glossiness target value in the first embodiment.

FIG. 13B is a graph illustrating glossiness before the color separation processing, glossiness after the color separation processing, and the glossiness target value in the first embodiment. As illustrated in FIG. 13B, the glossiness after the color separation processing is closer to the glossiness target value relative to the glossiness before the color separation processing.

Figure 14:
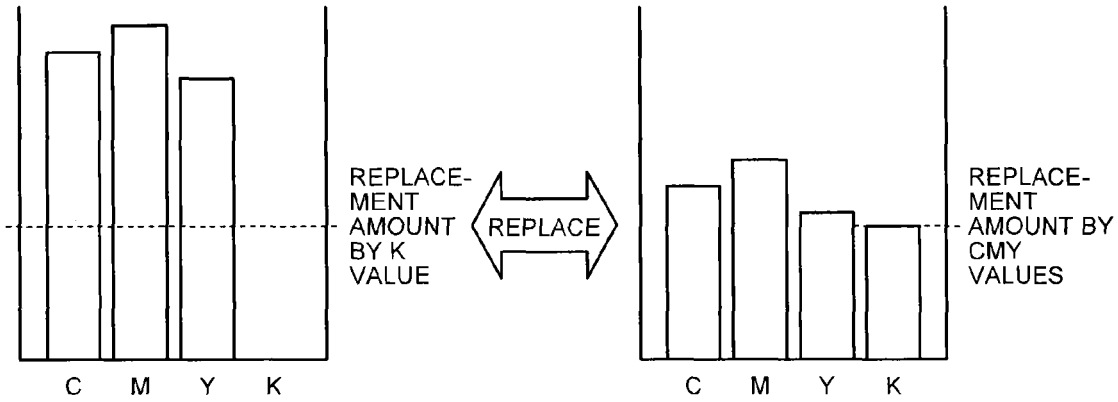
FIG. 14 is an exemplary view conceptually illustrating the color separation processing between CMY values and a K value in the first embodiment.

FIG. 14 is an exemplary view conceptually illustrating the color separation processing between the CMY values and the K value in this case. As illustrated in FIG. 14, the color separation processing unit 5117 performs color replacement with the color separation amounts determined by the color separation amount determining unit 5115 using a general under color removal algorithm that components formed by superimposition of three colors of C, M, and Y are reduced and they are replaced by K, that is a under color removal (UCR) algorithm. The color replacement is not limited to be performed in this manner and the color separation processing unit 5117 may be configured to perform the color replacement between the CMY values and the K value using a grey component replacement (GCR) algorithm or unique algorithm, for example.

Thus, the color separation processing unit 5117 adjusts the CMY values and the K value finally, so that the glossiness is adjusted. As a result, the pieces of colored plane data 5121 are provided by the outputs from the plane adjusting unit 511. In the first embodiment, adjustment related to the gloss-control plane data is not executed and data same as the input data is output, as the gloss-control plane data 5122, as the output from the plane adjusting unit 511, as a result.

When the sum of the color materials of the pieces of colored plane data and the gloss-control plane data provided as the outputs finally is larger than the total amount defined by an engine at a subsequent stage, processing of restricting the total amount of the color materials within a constant value may be executed using general total amount restricting processing.

The clear processing 56 receives the 8-bit data of gloss-control plane converted by the rendering engine 51 via the si1 unit 52 and receives the pieces of 8-bit colored plane data of CMYK on which the gamma correction is performed by the TRC 53 via the si2 unit 54.

The clear processing 56 stores therein the surface effect selection table, which will be described later. The clear processing 56 stores therein the 8-bit gloss-control plane data input from the si1 unit 52.

The clear processing 56 determines the surface effect corresponding to the density value (pixel value) of each pixel constituting the gloss-control plane using the gloss-control plane data input from the si1 unit 52 by referring to the surface effect selection table, which will be described later. In accordance with the determination, the clear processing 56 determines whether to turn ON or OFF the glosser 80. In addition, the clear processing 56 uses the pieces of 8-bit colored plane data of CMYK thus received to generate an inverse mask or a solid mask as appropriate. Thus, the clear processing 56 generates 2-bit data of the clear-toner plane to which the clear toner is to be adhered as appropriate. Based on the result of determination of the surface effect, the clear processing 56 generates and outputs clear toner plane data to be used in the printer 70 and clear toner plane data to be used in the low-temperature fixing unit 90 appropriately and outputs ON/OFF information indicating ON/OFF of the glosser 80.

The inverse mask makes the total amount of adhered CMYK toners and an adhered clear toner uniform on pixels constituting a target area to which the surface effect is to be applied. Specifically, the inverse mask is generated by adding all the density values of the pixels constituting the target area in the image data of the CMYK plane and subtracting the value thus added from a predetermined value. The inverse mask 1, for example, is expressed by Equation (1):

$$\mathrm{Clr}=100-(C+M+Y+K) \tag{1}$$

in the case of Clr<0, Clr=0 is satisfied.

In Equation (1), Clr, C, M, Y, and K represent the density rate converted from the density value of each pixel for the clear toner and each toner of C, M, Y, and K, respectively. In other words, by using Equation (1), the total amount of adhered toners obtained by adding the amount of the adhered clear toner to the total amount of the adhered toners of C, M, Y, and K is made 100% for all the pixels constituting the target area to which the surface effect is to be applied. If the total amount of the adhered toners of C, M, Y, and K is equal to or larger than 100%, no clear toner is to be adhered, and the density rate of the clear toner is made 0%. This is because the part where the total amount of the adhered toners of C, M, Y, and K exceeds 100% is made smooth by fixing processing. By making the total amount of the adhered toner on all the pixels constituting the target area to which the surface effect is to be applied equal to or larger than 100% in this manner, it is possible to eliminate unevenness on the surface caused by difference in the total amount of the adhered toner in the target area. As a result, gloss is generated by specular reflection of light. Because some inverse masks are derived from equations other than Equation (1), there can be a plurality of types of inverse masks.

The inverse mask, for example, may cause the clear toner to uniformly adhere to the pixels. In this case, the inverse mask is also referred to as a solid mask and is expressed by Equation (2):

$$\mathrm{Clr}=100 \tag{2}$$

Because some of the pixels to which the surface effect is to be applied may be associated with a density rate other than 100%, there can be a plurality of types of solid masks.

Alternatively, the inverse mask may be derived by multiplication of the background exposure rate of each color, for example. In this case, for example, the inverse mask is expressed by Equation (3):

$$\mathrm{Clr}=100\times\{(100-C)/100\}\times\{(100-M)/100\}\times\{(100-Y)/100\}\times\{(100-K)/100\} \tag{3}$$

In Equation (3), (100−C)/100 represents the background exposure rate of C, (100−M)/100 represents the background exposure rate of M, (100−Y)/100 represents the background exposure rate of Y, and (100−K)/100 represents the background exposure rate of K.

Still alternatively, the inverse mask may be derived by a method assuming that halftone dots having the largest area ratio achieve the smoothness. In this case, for example, the inverse mask is expressed by Equation (4):

$$\mathrm{Clr}=100-\max(C,M,Y,K) \tag{4}$$

In Equation (4), max(C,M,Y,K) indicates that the density value of a color having the largest density value among CMYK is a representative value.

In other words, the inverse mask may be expressed by any one of Equation (1) to Equation (4).

Next, a surface effect selection table will be described. The surface effect selection table indicates correspondence relation between the density values serving as gloss-control values indicating surface effects and the types of the surface effects. In addition, the surface effect selection table indicates correspondence relation among control information related to the post-processing device in accordance with the configuration of the image forming system, the data of the clear-toner plane used in the printer 70, and the data of the clear-toner plane used in the post-processing device.

While the image forming system can have various configurations, the image forming system according to the present embodiment has a configuration in which the glosser 80 and the low-temperature fixing unit 90 serving as the post-processing devices are connected to the printer 70. Therefore, the control information related to the post-processing device in accordance with the configuration of the image forming system corresponds to the ON-OFF information indicating "ON" or "OFF" of the glosser 80. The clear toner plane data to be used in the post-processor corresponds to the clear toner plane data to be used in the low-temperature fixing unit 90.

FIG. 15 is an exemplary schematic of a data structure of the surface effect selection table. The surface effect selection table may be configured to indicate a correspondence relation among pieces of control information related to the post-processor, pieces of image data of a clear toner plane 1 to be used in the printer 70, pieces of image data of a clear toner plane 2 to be used in the post-processors, density values, and types of the surface effects for each configuration of different image formation systems. FIG. 15 illustrates a data structure in accordance with the configuration of the image formation system in the first embodiment. FIG. 15 illustrates a data structure corresponding to the configuration of the printing control system according to the present embodiment. In the correspondence relation between the types of surface effects and the density values illustrated in FIG. 12, the types of surface effects are associated with respective ranges of the density values. Furthermore, the types of surface effects are associated with respective rates of density (density rates) each converted from a value (a representative value) serving as a representative of a range of density values in units of 2%. Specifically, surface effects for providing gloss (premium gloss effect and gloss effect) are associated with ranges of density values (from "212" to "255") having a density rate of equal to or larger than 84%. By contrast, a surface effect for suppressing gloss (matt and premium matt) is associated with ranges of density values (from "1" to "43") having a density rate of equal to or smaller than 16%. Furthermore, surface effects, such as a texture, a background pattern, and a watermark, are associated with ranges of density values having density rates of 20% to 80%.

To make description using the surface effect selection table as an example, premium gloss (PG) is associated with pixel values of "238" to "255" as the surface effect. In these pixel values, three different types of premium gloss are associated with respective ranges of pixel values of "238" to "242", pixel values of "243" to "247", and pixel values of "248" to "255".

Gloss (G) is associated with pixel values of "212" to "232". In these pixel values, four different types of gloss are associated with respective ranges of pixel values of "212" to "216", pixel values of "217" to "221", pixel values of "222" to "227", and pixel values of "228" to "232".

Matt (M) is associated with pixel values of "23" to "43". In these pixel values, four different types of matt are associated with respective ranges of pixel values of "23" to "28", pixel values of "29" to "33", pixel values of "34" to "38", and pixel values of "39" to "43". Premium matt (PM) is associated with pixel values of "1" to "17". In these pixel values, three different types of premium matt are associated with respective ranges of pixel values of "1" to "7", pixel values of "8" to "12", and pixel values of "13" to "17". These different types of the same surface effect are different from one another in equations for deriving data of the clear-toner plane to be used in the printer 70 and the low-temperature fixing unit 90. The printer main body and the post-processing device each perform the same operation. No surface effect is associated with a density value of "0".

In FIG. 15, contents of ON/OFF information indicating ON or OFF of the glosser 80, contents of the image data (Clr-1 in FIG. 1) of the clear toner plane 1 to be used in the printer 70, and contents of the image data of the clear toner plane 2 to be used in the low-temperature fixing unit 90 are indicated so as to correspond to the respective pixel values and surface effects. For example, FIG. 15 indicates that when the surface effect is premium gloss, the glosser 80 is made into an ON state, the image data of the clear toner plane 1 to be used in the printer 70 is the inverse mask, and the image data (Clr-2 in FIG. 1) of the clear toner plane 2 to be used in the low-temperature fixing unit 90 is absent. The inverse mask is provided by the above-mentioned equation 1, for example. The example as illustrated in FIG. 15 indicates the case where an area to which the mirror effect as the surface effect is specified to be applied corresponds to the entire area defined by the image data. The case where the area to which the mirror effect as the surface effect is specified to be applied corresponds to a part of the area defined by the image data will be described later.

FIG. 15 indicates that when the density value is in a range of "228" to "232" and the surface effect is gloss, the glosser 80 is made into an OFF state, the image data of the clear toner plane 1 to be used in the printer 70 is an inverse mask 1, and the image data of the clear toner plane 2 to be used in the low-temperature fixing unit 90 is absent.

It is sufficient that the inverse mask 1 is a mask expressed by any one of the above-mentioned equations 1 to 4. In this case, the glosser 80 is in the OFF state, so that the total adhesion amount of toners to be smoothened is uneven. Due to this, irregularities on the surface are increased in comparison with the premium gloss. As a result, gloss the glossiness of which is lower than that of the premium gloss is applied. Furthermore, FIG. 15 indicates that when the surface effect is matt, the glosser 80 is made into the OFF state, the image data of the clear toner plane 1 to be used in the printer 70 is halftone, and the image data of the clear toner plane 2 to be used in the low-temperature fixing unit 90 is absent. FIG. 15 indicates that when the surface effect is premium matt, the glosser 80 may be made into the ON state or OFF state, the image data of the clear toner plane 1 to be used in the printer 70 is absent, and the image data of the clear toner plane 2 to be used in the low-temperature fixing unit 90 is a solid mask. The solid mask is provided by the above-mentioned equation 2, for example.

The clear processing 56 refers to the surface effect selection table to determine the surface effect associated with each pixel value indicated by the data of the gloss-control plane. In addition, the clear processing 56 determines whether to turn ON or OFF the glosser 80 and determines the type of image data of the clear-toner plane to be used in the printer 70 and the low-temperature fixing unit 90. The clear processing 56 determines whether to turn ON or OFF the glosser 80 for each page. Subsequently, as described above, the clear processing 56 generates and outputs the data of the clear-toner plane based on the result of the determination as appropriate. In addition, the clear processing 56 outputs the ON-OFF information of the glosser 80. With this, the clear toner plane data having a gloss effect that is intended by the user is generated in accordance with the sheet type.

The si3 unit 57 integrates the pieces of 2-bit data of CMYK on which the halftone processing is performed and the 2-bit image data of the clear-toner plane generated by the clear processing 56 and outputs the image data thus integrated to the MIC 60. The clear processing 56 does not generate at least one of the clear toner plane data to be used in the printer 70 and the clear toner plane data to be used in the low-temperature fixing unit 90 in some cases. The si3 unit 57 integrates the clear toner plane data generated by the clear processing 56. When the clear processing 56 does not generate any of the pieces of clear toner plane data, the si3 unit 57 outputs image data formed by integrating the pieces of 2-bit image data of CMYK. As a result, the DFE 50 outputs four to six pieces of 2-bit image data to the MIC 60. The si3 unit 57 also outputs the ON-OFF information of the glosser 80 received from the clear processing 56 to the MIC 60.

Figure 16:
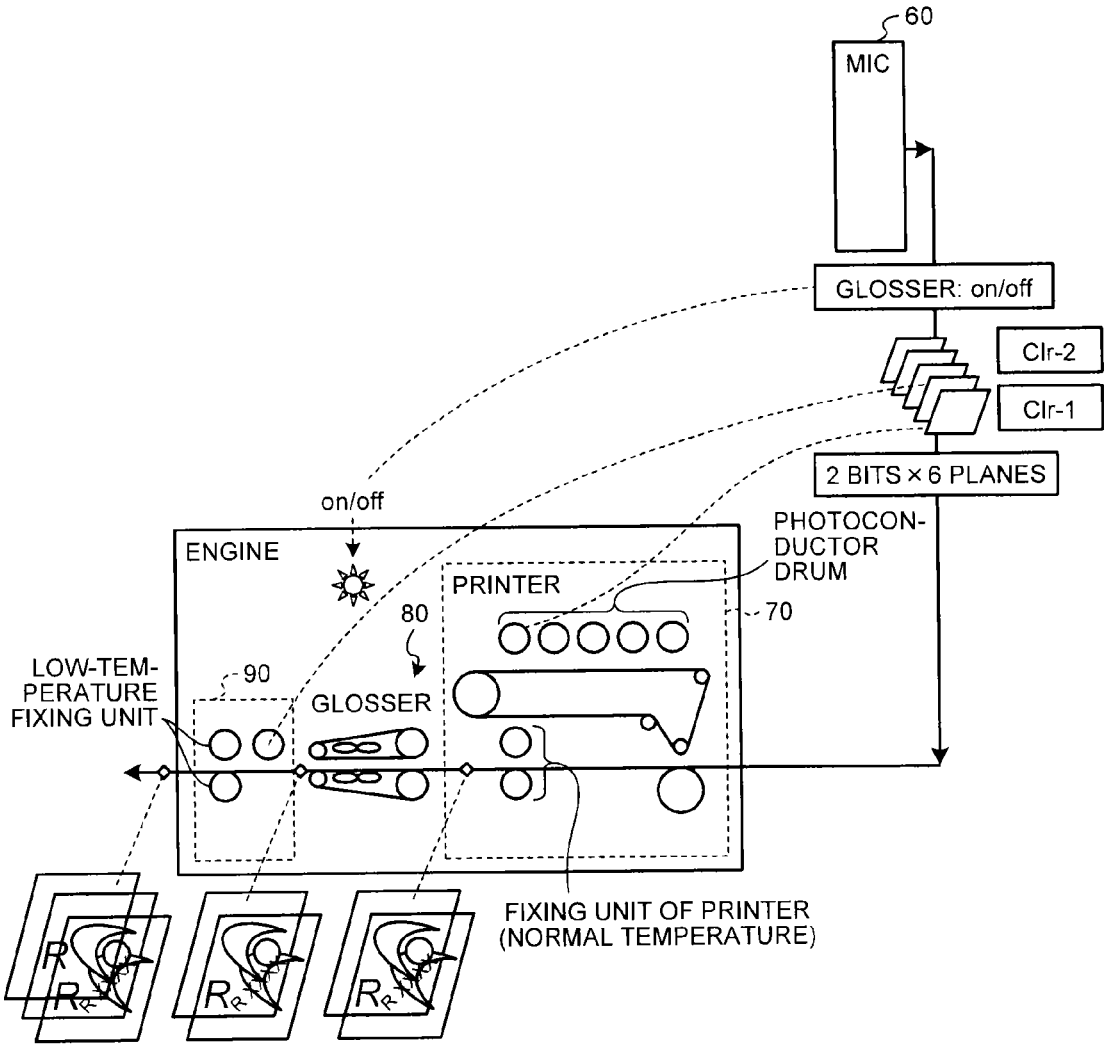
FIG. 16 is an exemplary view conceptually illustrating the configurations of a mechanism I/F controller (MIC) and a printer in the first embodiment.

The MIC 60 is connected to the DFE 50 and the printer 70. The MIC 60 outputs device configuration information indicating the configuration of the device provided as the post-processing device to the DFF 50. The MIC 60 receives pieces of the colored plane data and pieces of the clear-toner plane data from the DFE 50. The MIC 60 then sorts the pieces of image data into devices corresponding thereto and controls the post-processing device. To be more specific, as illustrated in FIG. 16, the MIC 60 outputs the pieces of colored plane data of CMYK among the pieces of image data output from the DFE 50 to the printer 70 and outputs the clear toner plane data to be used in the printer 70 to the printer 70 when it is present, turns ON or OFF the glosser 80 using the ON/OFF information output from the DFE 50, and outputs the clear toner plane data to be used in the low-temperature fixing unit 90 to the low-temperature fixing unit 90 when it is present. The glosser 80 may be switched between a path for performing fixing and a path for performing no fixing based on the ON-OFF information. The low-temperature fixing unit 90 may switch ON or OFF and switch a path as in the glosser 80 based on the presence or absence of the clear toner plane data.

As illustrated in FIG. 16, the printing device 30 constituted by the printer 70, the glosser 80, and the low-temperature fixing unit 90 includes a transportation path for transporting a recording medium. Specifically, the printer 70 includes a plurality of electrophotography photosensitive drums, a transfer belt onto which a toner image formed on the photosensitive drums is transferred, a transfer device that transfers a toner image on the transfer belt onto a recording medium, and a fixing unit that fixes a toner image on a recording medium to the recording medium. The recording medium is transported on the transportation path by a transportation member (not illustrated) so as to be transported through positions at which the printer 70, the glosser 80, and the low-temperature fixing unit 90 are provided in this order. After these devices sequentially perform processing on the recording medium to form an image and apply a surface effect thereto, the recording medium is conveyed by a conveying mechanism, which is not illustrated, through the conveying path and is ejected outside of the printing device.

When the image data output from the DFE 50 contains the pieces of colored plane data of CMYK and clear toner plane data, colored images that are specified by the pieces of colored plane data are formed on the recording medium with the colored toners, and the surface effect of the type specified by the clear toner plane data is applied to the recording medium with the clear toner and a transparent image specified by the clear toner plane data is formed on the recording medium with the clear toner. That is to say, the surface effect based on the clear toner plane data having a gloss effect intended by the user in accordance with the sheet type is applied to the recording medium.

Figure 17:
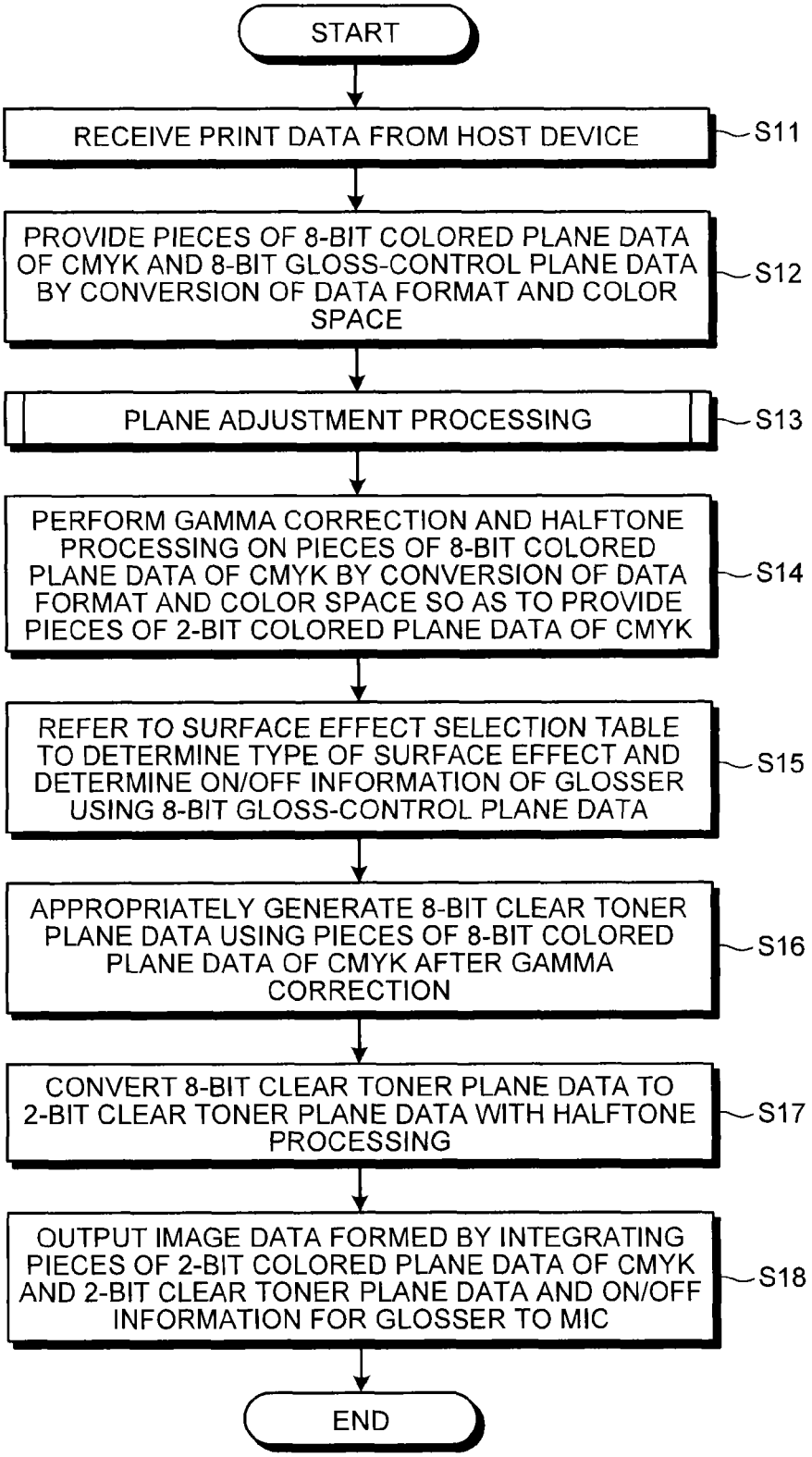
FIG. 17 is a flowchart illustrating procedures of gloss control processing that is performed by the image formation system in the first embodiment.

Next, procedures of gloss control processing that is performed by the image formation system in the first embodiment will be described with reference to FIG. 17. When the DFE 50 receives print data from the host device 10 (step S11), the rendering engine 51 interprets the language of the image data to convert the image data expressed in a vector format into image data expressed in a raster format and convert a color space expressed in an RGB format or the like into a color space in a CMYK format so as to provide pieces of 8-bit colored plane data of CMYK and 8-bit gloss-control plane data (step S12).

In the conversion processing of the gloss-control plane data, the gloss-control plane data as illustrated in FIG. 4, that is, the gloss-control plane data in which density values specifying the surface effects are specified for the respective drawn objects as illustrated in FIG. 7 is converted to gloss-control plane data in which density values are specified for the respective pixels constituting the drawn objects.

That is to say, the rendering engine 51 applies the density values set to the drawn objects to the pixels in a range of coordinates corresponding to the drawn objects of the gloss-control plane data as illustrated in FIG. 7 so as to convert the gloss-control plane data. This causes the gloss-control plane data to be converted to the gloss-control plane data in which the surface effects are set to the respective pixels.

Figure 18:
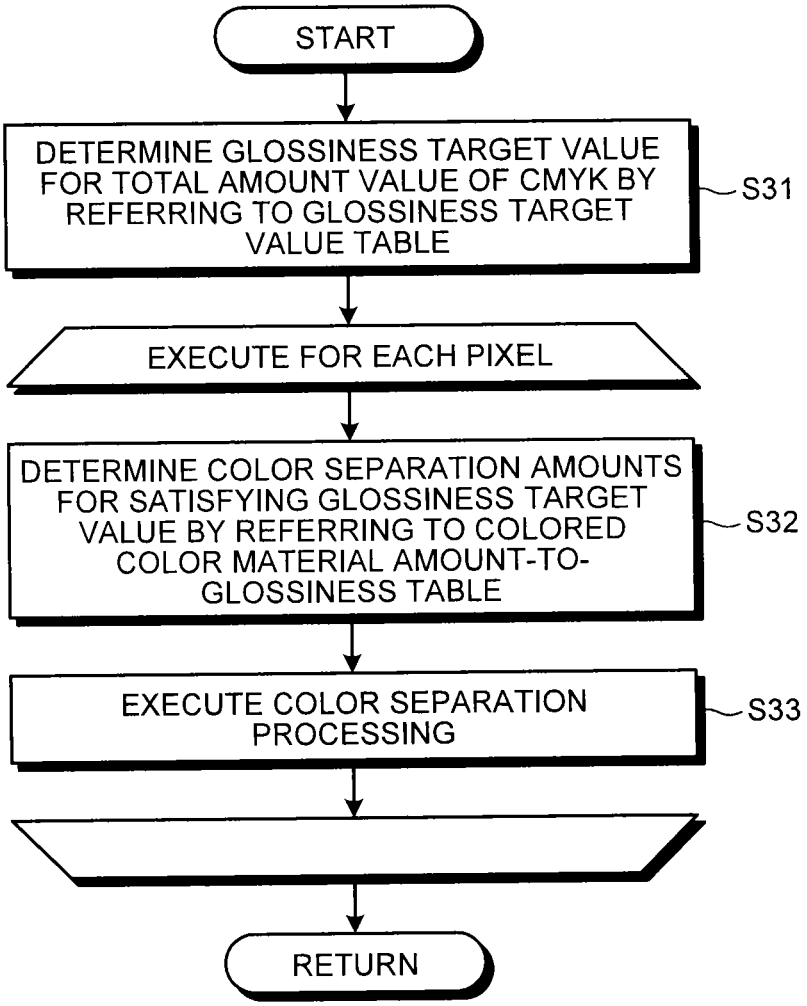
FIG. 18 is a flowchart illustrating procedures of plane adjustment processing in the first embodiment.

When the 8-bit gloss-control plane data is output, the plane adjusting unit 511 performs plane adjustment processing (step S13). FIG. 18 is a flowchart illustrating procedures of the plane adjustment processing in the first embodiment.

First, the glossiness target value determining unit 5113 determines a glossiness target value for the total amount value of CMYK by referring to the glossiness target value table 5114 (step S31).

Subsequently, pieces of processing at the following steps S32 and S33 are executed on the respective pixels of the pieces of colored plane data 5111 as the image data as the print target. At step S32, the color separation amount determining unit 5115 determines color separation amounts for satisfying the glossiness target value as described above by referring to the colored color material amount-to-glossiness table 5116 (step S32). Then, the color separation amount determining unit 5115 performs the color separation processing based on the determined color separation amounts (step S33).

Returning back to FIG. 17, when the color separation processing has been performed, the TRC 53 of the DFE 50 performs gamma correction with a gamma curve of 1D LUT generated by calibration on the pieces of 8-bit colored plane data of CMYK, and outputs the pieces of 8-bit colored plane data of CMYK after the gamma correction to the halftone engine 55 and the clear processing 56 through the si2 unit 54. The halftone engine 55 performs halftone processing of converting the pieces of image data after the gamma correction to pieces of 2-bit colored plane data of CMYK in a data format capable of being output to the printer 70 so as to provide the pieces of 2-bit colored plane data of CMYK after the halftone processing (step S14).

Thereafter, the clear processing 56 refers to the surface effect selection table corresponding to the sheet type selected at step S14 to determine the surface effect specified for each pixel value indicated by the gloss-control plane data using the 8-bit gloss-control plane data. Then, the clear processing 56 makes this determination for all the pixels configuring the gloss-control plane data. In the gloss-control plane data, all the pixels configuring the area to which each surface effect is applied indicate density values in the same range basically. For this reason, the clear processing 56 determines that close pixels to which the same surface effect has been determined to be applied are contained in the area to which the same surface effect is applied. In this manner, the clear processing 56 determines an area to which a surface effect is applied and a type of the surface effect that is applied to the area. Thereafter, the clear processing 56 determines whether to turn ON or OFF the glosser 80 in accordance with the determination (step S15).

Then, the clear processing 56 appropriately generates 8-bit clear toner plane data for making the clear toner adhere using the pieces of 8-bit colored plane data of CMYK after the gamma correction that are output from the si2 unit 54 as appropriate (step S16). The halftone engine 55 converts the 8-bit clear toner plane data generated using the pieces of 8-bit image data to 2-bit clear toner plane data with the halftone processing (step S17).

Subsequently, the Si3 unit 57 of the DFE 50 integrates the pieces of 2-bit colored plane data of CMYK after the halftone processing that have been provided at step S13 and the 2-bit clear toner plane data that has been provided at step S17, and outputs the integrated image data and the ON/OFF information indicating ON or OFF of the glosser 80 that has been determined at step S15 to the MIC 60 (step S18).

When the clear processing 56 does not generate the clear toner plane data at step S16, only the pieces of 2-bit colored plane data of CMYK after the halftone processing that have been provided at step S13 are integrated and output to the MIC 60 at step S18.

In the first embodiment, for coping with the unevenness of the glossiness, amounts of the colored color materials are adjusted without adjusting the clear color material on portions having glossiness diverged from target glossiness. This adjustment can eliminate the difference in the glossiness on the entire surface and improve print quality.

Second Embodiment

Although the glossiness target value is defined uniformly regardless of a sheet type in the first embodiment, color separation processing is performed while defining glossiness target values in accordance with sheet types in a second embodiment. Description of portions of the configuration of a printing system, the functions and configurations of the DFE 50, the MIC 60, and the printing device 30, and processing flows in the second embodiment that are common to and overlapped with those in the first embodiment is omitted.

FIG. 19 is an exemplary view illustrating glossiness target value tables defining the glossiness target values in accordance with the sheet types in the second embodiment. In FIG. 19, the glossiness target value table corresponding to the glossiness target value table 5114 in FIG. 10 and defining the glossiness target value relative to the total amount of the CMYK values is specified for each sheet type. Although the target value tables for three sheet types are illustrated in the second embodiment, the number of sheet types may not be limited to three.

In the second embodiment, the plane adjusting unit 511 of the DFE 50 receives a type of a sheet on which printing is performed from the host device 10. Then, the glossiness target value determining unit 5113 of the plane adjusting unit 511 reads a glossiness target value corresponding to the received sheet type from the glossiness target value table 5114 and determines it at step S31 in FIG. 18. Determination (step S32 in FIG. 18) of the color separation amounts and the color separation processing (color replacement processing, processing at S33) are the same as those in the first embodiment.

According to the second embodiment, individual glossiness target values in accordance with sheet types are defined as the glossiness target value table 5114. The plane adjusting unit 511 determines the glossiness target value in accordance with the type of the sheet on which printing is performed from the glossiness target value table 5114 and performs the color separation processing so as to specify an optimum glossiness target value for the sheet type and further improve print quality.

Third Embodiment

In a third embodiment, a glossiness target value is determined based on gloss-control plane data. Description of portions of the configuration of a printing system, the functions and configurations of the DFE 50, the MIC 60, and the printing device 30, and processing flows in the third embodiment that are common to and overlapped with those in the first embodiment is omitted.

The glossiness target value determining unit 5113 in the plane adjusting unit 511 of the DFE 50 in the third embodiment determines the glossiness target value based on the gloss-control plane data. To be more specific, the glossiness target value determining unit 5113 determines the glossiness target value using a histogram of the glossiness of the gloss-control plane data.

Figure 20:
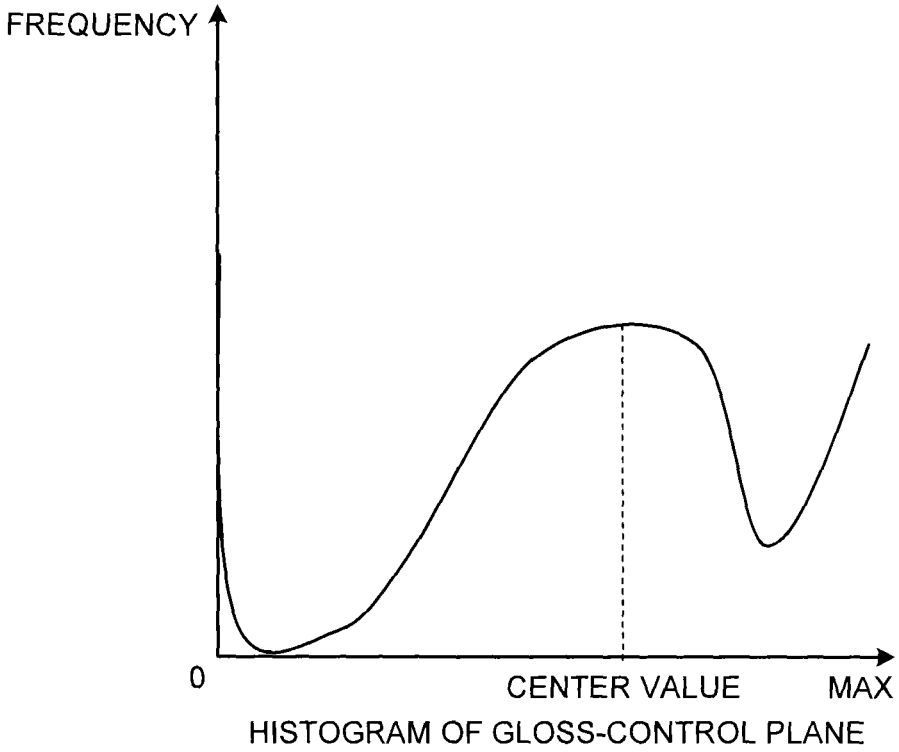
FIG. 20 is an exemplary graph illustrating a method of calculating a glossiness target value from a histogram of gloss-control plane data according to a third embodiment of the present invention.

FIG. 20 is an exemplary graph illustrating a method of calculating the glossiness target value from the histogram of the gloss-control plane data in the third embodiment. The glossiness target value determining unit 5113 statistically calculates the glossiness target value from the glossiness of each pixel in the gloss-control plane data. In an example as illustrated in FIG. 20, the glossiness target value determining unit 5113 calculates a center value of the histogram as the glossiness target value using the histogram of the glossiness of the gloss-control plane data.

The calculating method is not limited thereto and the glossiness target value determining unit 5113 can be configured to determine the glossiness target value using statistical data of an average value or the like of the histogram of the gloss-control plane data.

Furthermore, the method is not limited to the method using the histogram as long as the glossiness target value is determined based on the gloss-control plane data. For example, the glossiness target value determining unit 5113 can be also configured to determine a defined glossiness target value as a result of comparison and matching processing between configuration information of the gloss-control plane data and a defined pattern.

Determination of the color separation amounts and the color separation processing (color replacement processing) are the same as those in the first embodiment.

According to the third embodiment, the glossiness target value is determined based on the gloss-control plane data, so that an optimum glossiness target value can be specified, thereby further improving print quality.

Fourth Embodiment

In a fourth embodiment, a glossiness target value is determined based on specification by a user. Description of portions of the configuration of a printing system, the functions and configurations of the DFE 50, the MIC 60, and the printing device 30, and processing flows in the third embodiment that are common to and overlapped with those in the first embodiment is omitted.

Figure 21:
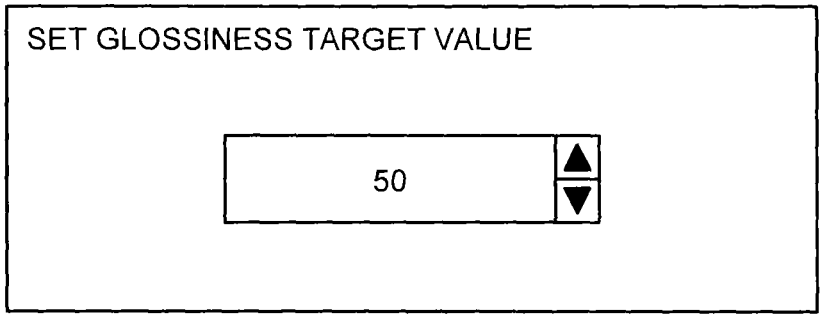
FIG. 21 is an exemplar view illustrating a method of specifying a glossiness target value by a user according to a fourth embodiment of the present invention.

The glossiness target value determining unit 5113 in the plane adjusting unit 511 of the DFE 50 in the fourth embodiment displays a setting screen of the glossiness target value on the display unit 59. FIG. 21 is a view illustrating an example of the setting screen of the glossiness target value in the fourth embodiment. The user inputs a desired glossiness target value through the setting screen of the glossiness target value. The glossiness target value determining unit 5113 determines the value input by the user through the setting screen of the glossiness target value as the glossiness target value. Determination of the color separation amounts and the color separation processing (color replacement processing) are the same as those in the first embodiment.

The example of FIG. 21 illustrates a method of directly specifying the glossiness target value. Alternatively, the glossiness target value determining unit 5113 may be configured such that options of several ways are previously prepared to cause the user to specify the target value from those options. Furthermore, the glossiness target value determining unit 5113 may be configured to cause the user to specify the glossiness target value while referring to the statistical information like that as illustrated in FIG. 20.

According to the fourth embodiment, a unit that causes the user to directly specify the target value is provided, so that an optimum glossiness target value can be specified, thereby further improving print quality.

Fifth Embodiment

In a fifth embodiment, the DFE 50 extracts an area to which a specific surface effect is applied based on gloss-control plane data and performs color separation processing on the extracted area. Description of portions of the configuration of a printing system, the functions and configurations of the DFE 50, the MIC 60, and the printing device 30, and processing flows in the fifth embodiment that are common to and overlapped with those in the first embodiment is omitted.

Figure 22:
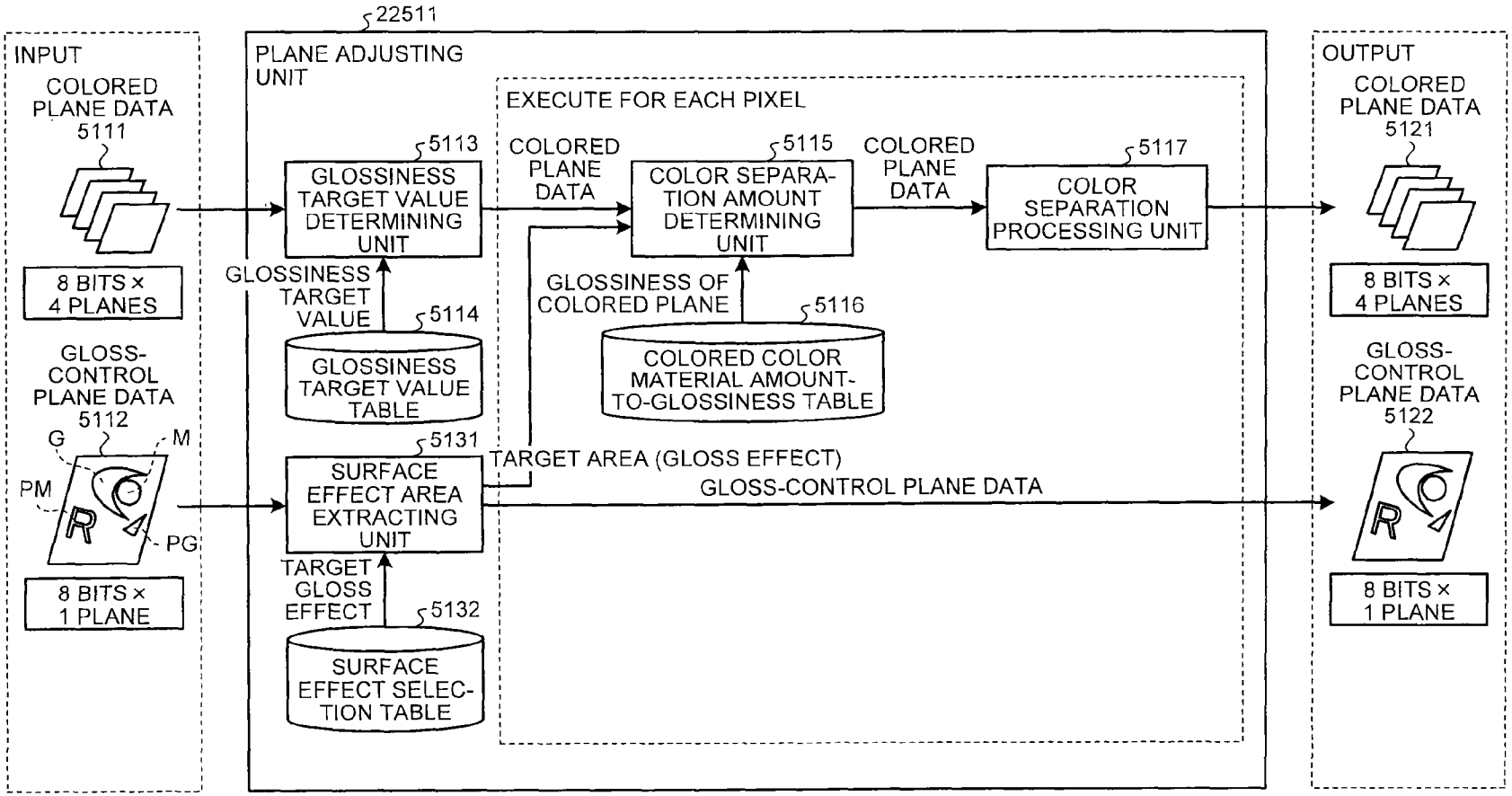
FIG. 22 is a block diagram illustrating an example of the functional configuration of a plane adjusting unit according to a fifth embodiment of the present invention.

FIG. 22 is a block diagram mainly illustrating the functional configuration of a plane adjusting unit 22511 in the fifth embodiment. As illustrated in FIG. 22, the plane adjusting unit 22511 mainly includes the glossiness target value table 5114, the color separation amount determining unit 5115, the colored color material amount-to-glossiness table 5116, the color separation processing unit 5117, a surface effect area extracting unit 5131, and a surface effect selection table 5132. The functions and configurations of the glossiness target value determining unit 5113, the glossiness target value table 5114, and the colored color material amount-to-glossiness table 5116 are the same as those in the first embodiment. The surface effect selection table 5132 is the same as that as described above with reference to FIG. 15 in the first embodiment and is a table in which types of surface effects that are applied to a sheet and areas on the sheet to which the surface effects are applied are specified.

As illustrated in FIG. 22, as in the first embodiment, the pieces of colored plane data 5111 are input to the glossiness target value determining unit 5113 and the gloss-control plane data 5112 (8 bits×1 plane) is input to the surface effect area extracting unit 5131. The surface effect area extracting unit 5131 extracts an area to which a specific surface effect is applied from the gloss-control plane data 5112 based on the gloss-control plane data 5112. The color separation amount determining unit 5115 determines color separation amounts of the respective colored color materials for the area extracted by the surface effect area extracting unit 5131. The color separation processing unit 5117 executes color replacement based on the color separation amounts determined by the color separation amount determining unit 5115 on the area extracted by the surface effect area extracting unit 5131.

Figure 23:
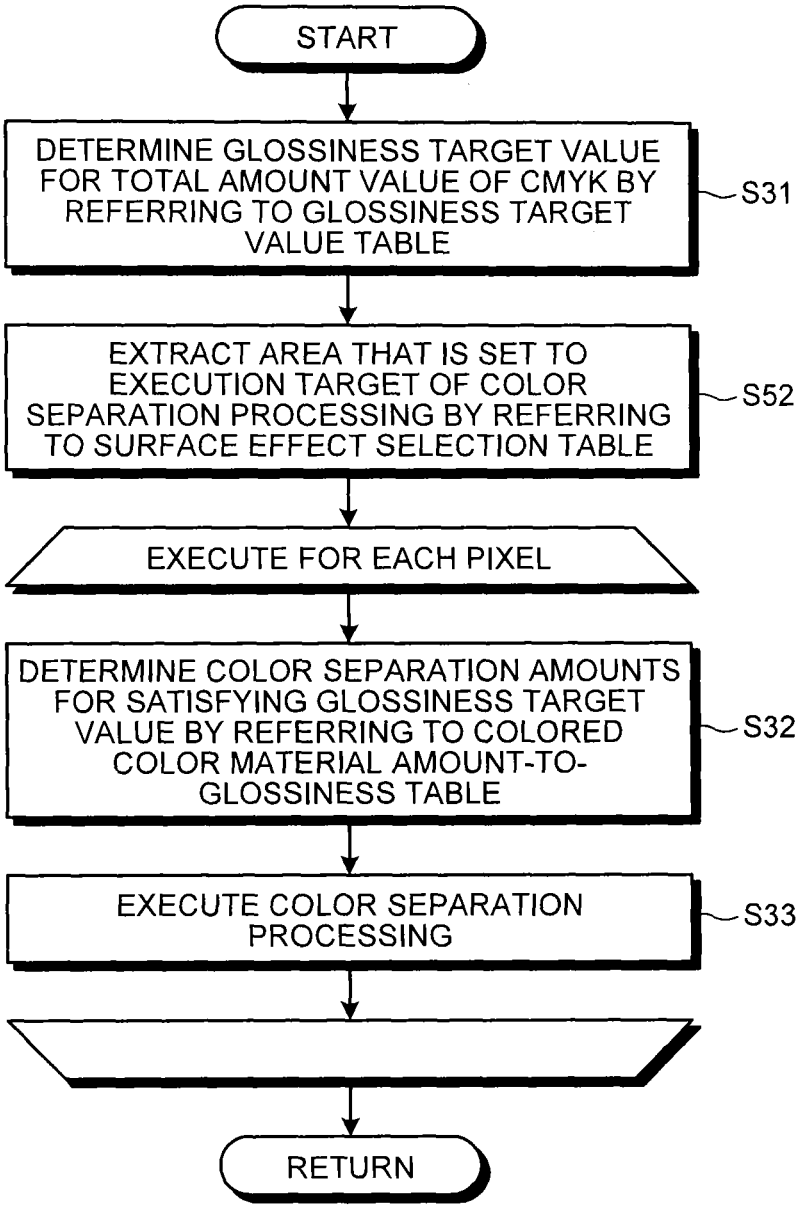
FIG. 23 is a flowchart illustrating an example of procedures of plane adjustment processing in the fifth embodiment.
Figure 24:
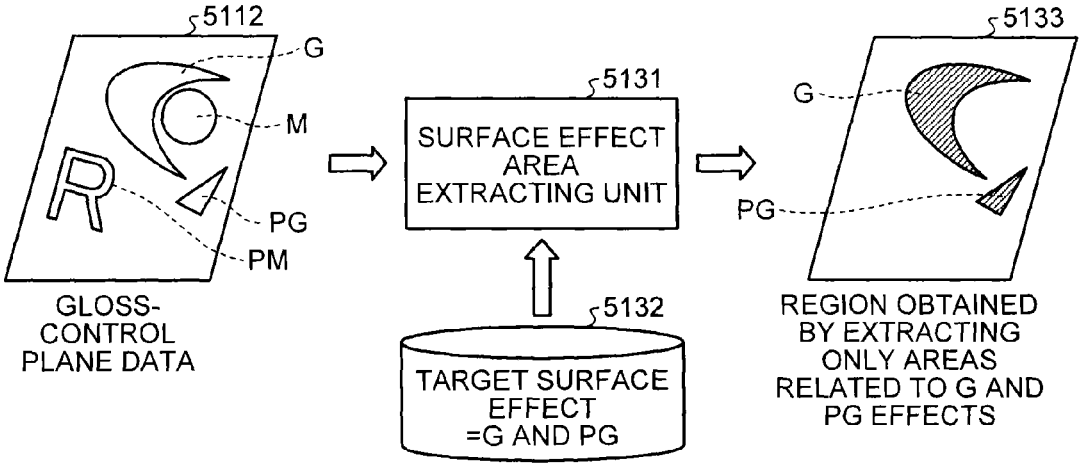
FIG. 24 is an exemplary view illustrating the case where only areas related to G and PG effects are extracted in the fifth embodiment.

FIG. 23 is a flowchart illustrating procedures of plane adjustment processing in the fifth embodiment. FIG. 24 is a view for explaining the plane adjustment processing in the fifth embodiment. First, as in the first embodiment, the glossiness target value determining unit 5113 determines a glossiness target value for the total amount value of CMYK by referring to the glossiness target value table 5114 (step S31).

Then, the surface effect area extracting unit 5131 extracts an area to which a specific surface effect is applied from the gloss-control plane data 5112, that is, an area that is set to an execution target of the color separation processing based on the gloss-control plane data 5112 (step S52). To be specific, the surface effect area extracting unit 5131 extracts only the area to which a target surface effect is applied based on information of the target gloss effect defined in the surface effect selection table 5132.

For example, the case where glossiness on high gloss portions is desired to be stabilized is supposed. In this case, it can be determined to be sufficient that only areas related to the surface effects of G (gloss) and PG (premium gloss) as target surface effects are set to be targets in consideration of the types of the surface effects related to presence or absence of gloss in the surface effect selection table 5132. FIG. 24 illustrates the case where the surface effect area extracting unit 5131 extracts only the areas related to the surface effects of G and PG. In FIG. 24, the gloss-control plane data 5112 is input to the surface effect area extracting unit 5131 and the surface effect area extracting unit 5131 outputs a region 5133 obtained by extracting the areas related to the surface effects of G and PG only.

Although only the areas related to the plurality of surface effects of G and PG are extracted in the example of FIG. 24, the extraction area is not limited thereto. The surface effect area extracting unit 5131 can be configured to extract areas related to other surface effects such as M (matt) and PM (premium matt). Alternatively, the surface effect area extracting unit 5131 may be configured to specify only a single surface effect as the number of surface effect as an extraction target.

The area information provided thereby is input to the color separation amount determining unit 5115. The color separation amount determining unit 5115 considers, as a condition, that only the area information is set to an execution target of the color separation processing. Then, the color separation processing unit 5117 at a subsequent stage executes the color separation processing, so that amounts of the colored color materials are adjusted. Detail determination processing of the color separation amounts at step S32 and color separation processing (color replacement processing) at step S33 are the same as those in the first embodiment.

According to the fifth embodiment, the color separation processing is executed only on the areas to which arbitrary surface effects are applied in the surface effect selection table 5132, so that the glossiness adjustment can be executed on only optimum areas.

Furthermore, according to the fifth embodiment, the target processing areas are limited so as to eliminate unnecessary color separation processing.

In the fifth embodiment, the gloss-control plane data is set to the target. When the print data does not contain the gloss-control plane data, the surface effect area extracting unit 5131 executes nothing and the configuration in the fifth embodiment is substantially the same as that in the first embodiment as illustrated in FIG. 10.

Sixth Embodiment

In a sixth embodiment, the DFE 50 extracts a specific area based on object information and performs color separation processing on the extracted area. Description of portions of the configuration of a printing system, the functions and configurations of the DFE 50, the MIC 60, and the printing device 30, and processing flows in the sixth embodiment that are common to and overlapped with those in the first embodiment is omitted.

Figure 25:
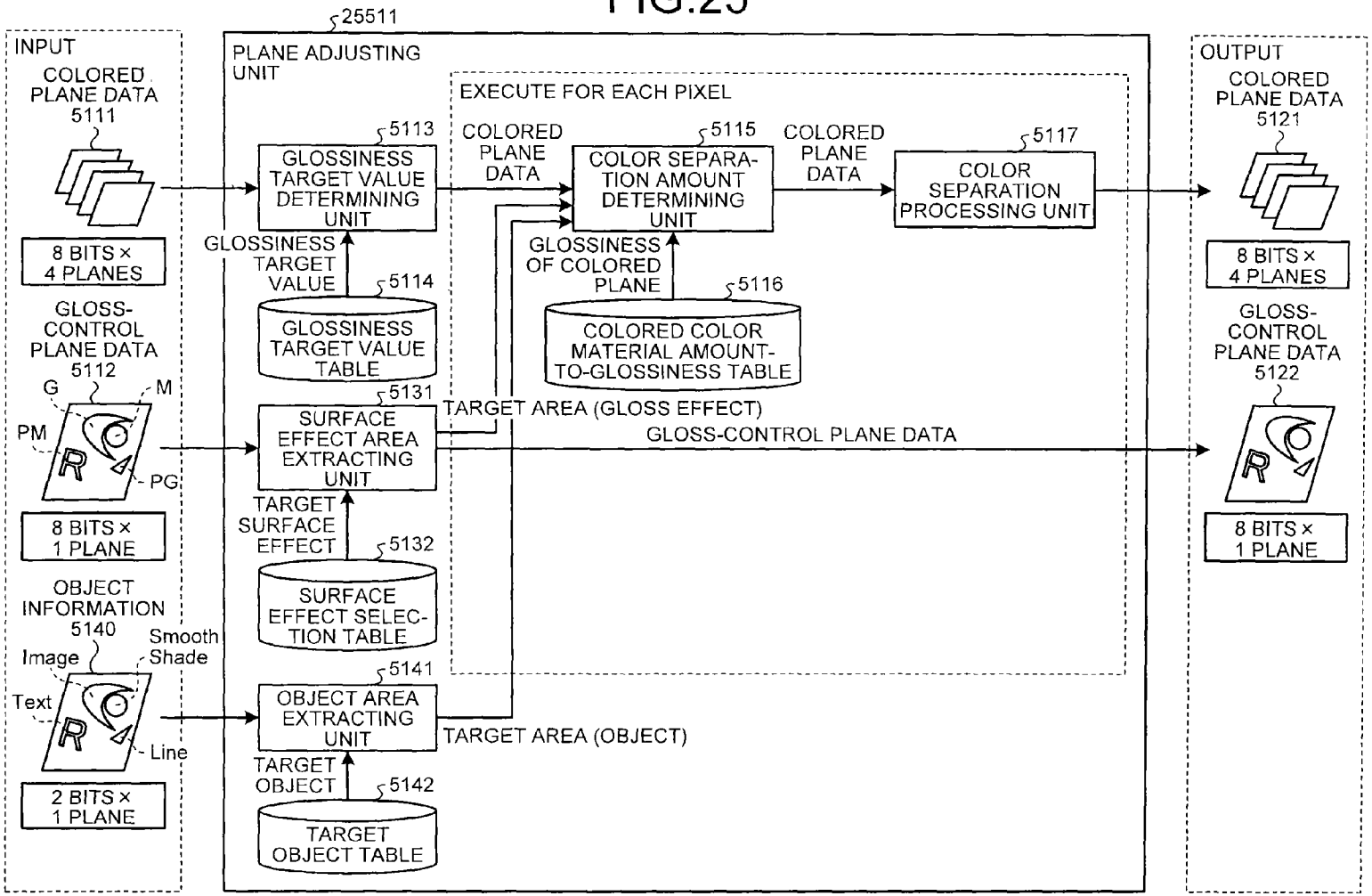
FIG. 25 is a block diagram illustrating an example of the functional configuration of a plane adjusting unit according to a sixth embodiment of the present invention.

FIG. 25 is a block diagram mainly illustrating the functional configuration of a plane adjusting unit 25511 in the sixth embodiment. As illustrated in FIG. 25, the plane adjusting unit 25511 mainly includes the glossiness target value table 5114, the color separation amount determining unit 5115, the colored color material amount-to-glossiness table 5116, the color separation processing unit 5117, the surface effect area extracting unit 5131, the surface effect selection table 5132, an object area extracting unit 5141, and a target object table 5142.

The functions and configurations of the glossiness target value determining unit 5113, the glossiness target value table 5114, and the colored color material amount-t glossiness table 5116 are the same as those in the first embodiment. Furthermore, the functions and configurations of the surface effect area extracting unit 5131 and the surface effect selection table 5132 are the same as those in the fifth embodiment.

As illustrated in FIG. 25, as in the fifth embodiment, the pieces of colored plane data 5111 are input to the glossiness target value determining unit 5113 and the gloss-control plane data 5112 (8 bits×1 plane) is input to the surface effect area extracting unit 5131. In addition, object information 5140 is input to the object area extracting unit 5141.

The object information 5140 is data in which positions, sizes, and pieces of attribute information of drawn objects contained in the pieces of colored plane data 5111 are registered in association with the pieces of colored plane data 5111 and the DFE 50 receives the object information from the host device 10. Although as the pieces of the attribute information of the object information 5140, there are four types of Text, Line, Smooth Shade, and Image in the sixth embodiment, the pieces of the attribute information are not limited thereto.

The target object table 5142 is a table in which objects extracted from the pieces of colored plane data 5111 are registered.

The object area extracting unit 5141 refers to the target object table 5142 and extracts an object area as an area of a specific drawn object from the object information 5140 in association with the pieces of colored plane data 5111. The color separation amount determining unit 5115 determines color separation amounts of respective colored color materials for the object area extracted by the object area extracting unit 5141. The color separation processing unit 5117 executes color replacement on the object area extracted by the object area extracting unit 5141 based on the color separation amounts determined by the color separation amount determining unit 5115.

Figure 26:
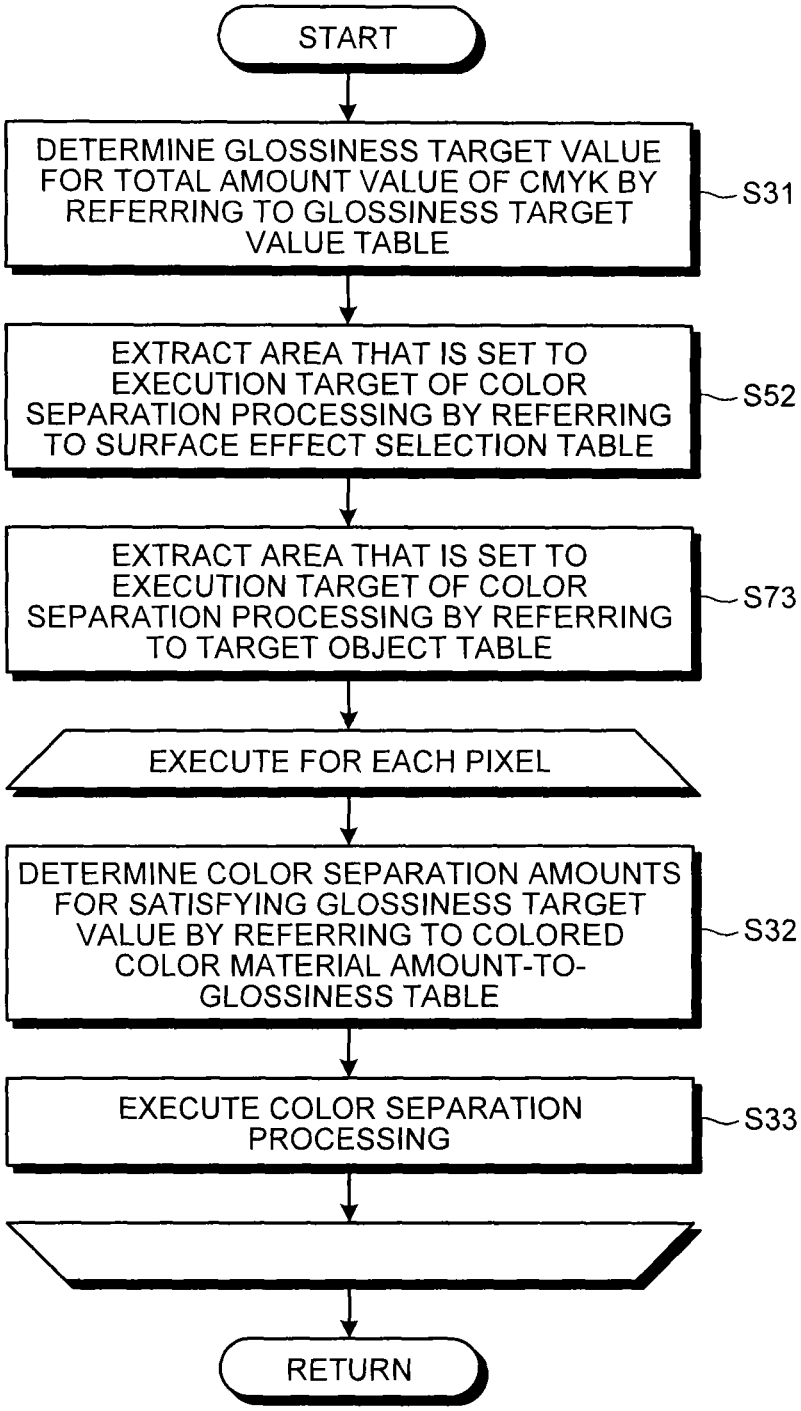
FIG. 26 is a flowchart illustrating an example of procedures of plane adjustment processing in the sixth embodiment.
Figure 27:
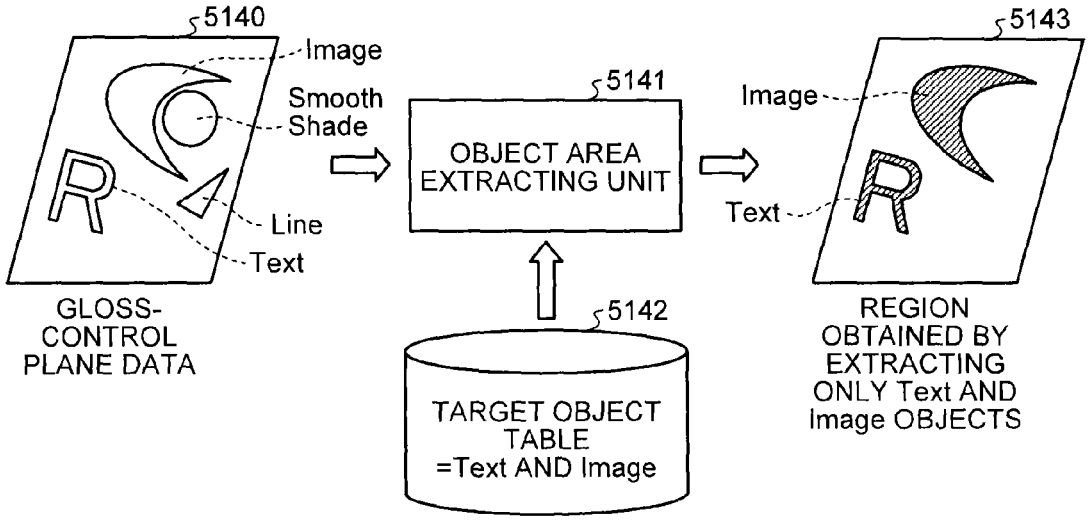
FIG. 27 is an exemplary view illustrating the case where only specific object areas are extracted in the sixth embodiment.

FIG. 26 is a flowchart illustrating procedures of plane adjustment processing in the sixth embodiment. FIG. 27 is an exemplary view illustrating the case where only specific object areas are extracted in the sixth embodiment. First, as in the first embodiment, the glossiness target value determining unit 5113 the glossiness target value for the total amount value of CMYK by referring to the glossiness target value table 5114 (step S31).

Then, as in the fifth embodiment, the surface effect area extracting unit 5131 extracts an area to which a specific surface effect is applied from the gloss-control plane data 5112, that is, an area that is set to an execution target of the color separation processing based on the gloss-control plane data 5112 (step S52).

Subsequently, the object area extracting unit 5141 extracts the object area as the area of the specific drawn object, that is, the area that is set to the execution target of the color separation processing from the object information 5140 in association with the pieces of colored plane data 5111 by referring to the target object table 5142 (step S73).

For example, the case where glossiness of characters and natural images is desired to be stabilized is supposed. In this case, it is sufficient that only Text and Image object areas are set to the targets as the target object table 5142. FIG. 27 illustrates the case where the object area extracting unit 5141 extracts only the Text and Image object areas. The object information 5140 is input and a region 5143 obtained by extracting only the Text and Image object areas are output though the object area extracting unit 5141.

Although the example of FIG. 27 illustrates the case where only the areas of the plurality of objects related to Text and Image are extracted, the extraction target is not limited thereto. For example, Line and Smooth Shade objects may be set to the extraction targets and a single object area as the number of target objects may be extracted.

The object area information provided in the above-mentioned manner is input to the color separation amount determining unit 5115. The color separation amount determining unit 5115 further adds a condition that only the area information is set to the execution target of the color separation processing. Then, the color separation processing unit 5117 at a subsequent stage executes the color separation processing, so that amounts of the colored color materials are adjusted. Detail determination processing of the color separation amounts at step S32 and color separation processing (color replacement processing) at step S33 are the same as those in the first embodiment.

According to the sixth embodiment, the color separation processing is executed only on the object areas corresponding to arbitrary objects, so that the glossiness adjustment can be executed on only optimum areas.

Furthermore, according to the sixth embodiment, the target processing areas are limited so as to eliminate unnecessary color separation processing.

Seventh Embodiment

In a seventh embodiment, the DFE 50 adjusts a color material amount of gloss-control plane data for glossiness after color separation processing. Description of portions of the configuration of a printing system, the functions and configurations of the DFE 50, the MIC 60, and the printing device 30, and processing flows in the seventh embodiment that are common to and overlapped with those in the first embodiment is omitted.

Figure 28:
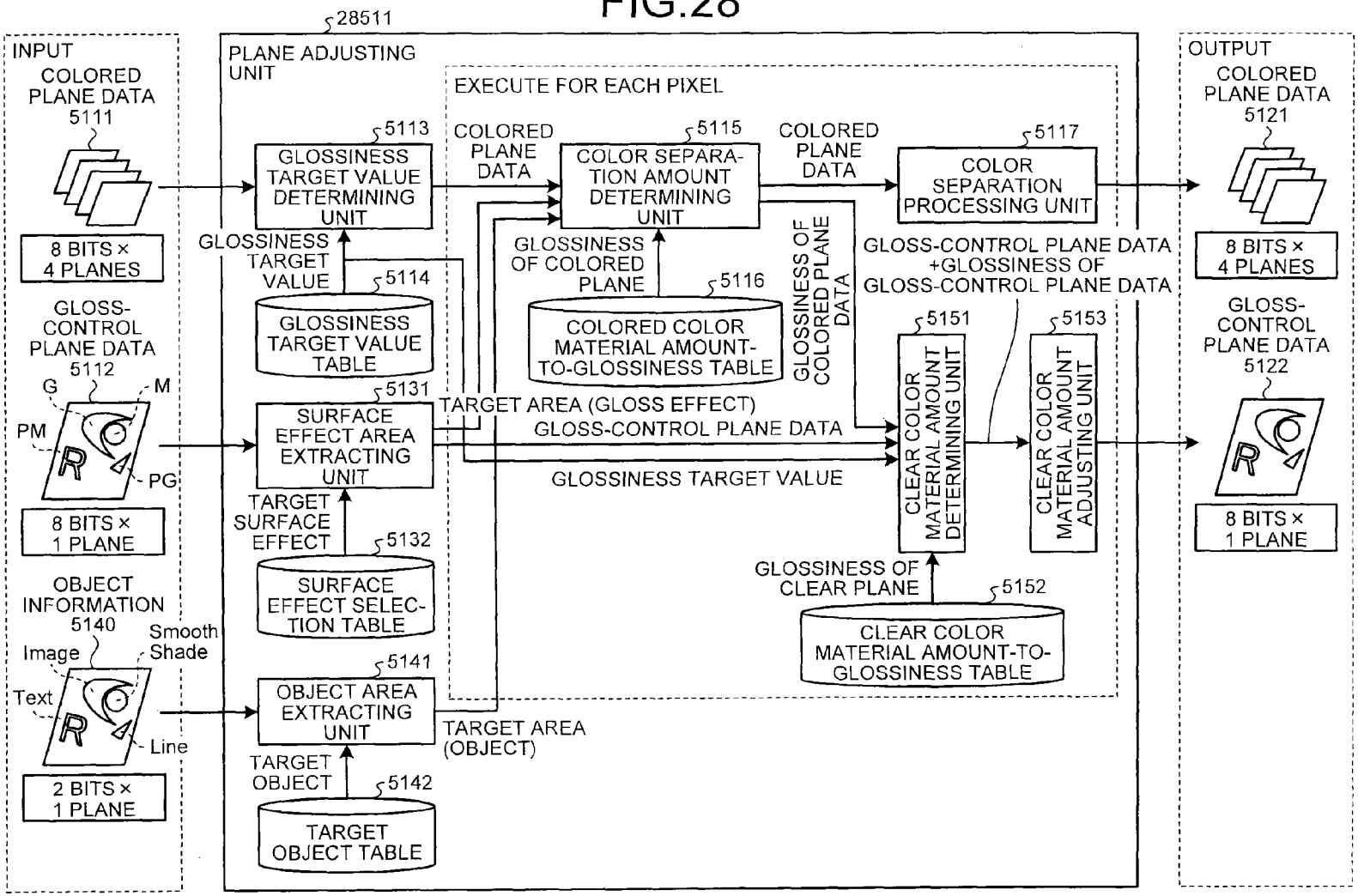
FIG. 28 is a block diagram illustrating an example of the functional configuration of a plane adjusting unit according to a seventh embodiment of the present invention.

FIG. 28 is a block diagram mainly illustrating the functional configuration of a plane adjusting unit 28511 in the seventh embodiment. As illustrated in FIG. 28, the plane adjusting unit 28511 mainly includes the glossiness target value table 5114, the color separation amount determining unit 5115, the colored color material amount-to-glossiness table 5116, the color separation processing unit 5117, the surface effect area extracting unit 5131, the surface effect selection table 5132, the object area extracting unit 5141, the target object table 5142, a clear color material amount determining unit 5151, a clear color material amount-to-glossiness table 5152, and a clear color material amount adjusting unit 5153.

The functions and configurations of the glossiness target value determining unit 5113, the glossiness target value table 5114, and the colored color material amount-to-glossiness table 5116 are the same as those in the first embodiment. The functions and configurations of the surface effect area extracting unit 5131 and the surface effect selection table 5132 are the same as those in the fifth embodiment. Furthermore, the functions and configurations of the object area extracting unit 5141 and the target object table 5142 are the same as those in the sixth embodiment.

As illustrated in FIG. 28, as in the sixth embodiment, the pieces of colored plane data 5111 are input to the glossiness target value determining unit 5113, the gloss-control plane data 5112 (8 bits×1 plane) is input to the surface effect area extracting unit 5131, and the object information 5140 is input to the object area extracting unit 5141.

The clear color material amount determining unit 5151 determines a clear color material amount as an amount of the clear color material based on glossiness after the color separation processing on the pieces of colored plane data 5111 of CMYK, glossiness by the gloss-control plane data 5112, and the glossiness target value. The clear color material amount determining unit 5151 obtains the glossiness by the gloss-control plane data 5112 by referring to the clear color material amount-to-glossiness table 5152.

Figure 29:
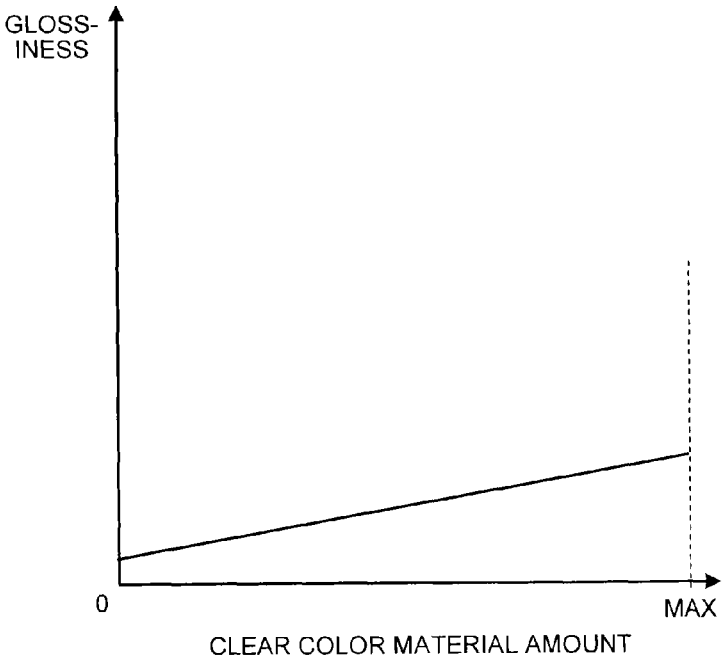
FIG. 29 is a graph illustrating an example of a clear color material amount-to-glossiness table in the seventh embodiment.

FIG. 29 is an exemplary graph conceptually illustrating the clear color material amount-to-glossiness table 5152 in the seventh embodiment. FIG. 29 illustrates glossiness for the clear color material amount. The example of FIG. 29 illustrates the clear color material amount-to-glossiness table 5152 having a characteristic that "as the clear amount is larger, the glossiness is higher". It should be noted that the clear color material amount-to-glossiness table 5152 is not limited thereto. For example, the clear color material amount-to-glossiness table 5152 may be configured to have characteristics that "the glossiness is high on portions having small clear color material amounts and portions having large clear color material amounts and the glossiness is low on portions with intermediate colors".

The execution result by the color separation amount determining unit 5115 reveals the glossiness by the pieces of colored plane data. The clear color material amount determining unit 5151 can calculate the degree of overage or shortage of the clear color material amount relative to the glossiness target value using the information and information obtained by referring to the clear color material amount-to-glossiness table 5152.

Figure 30:
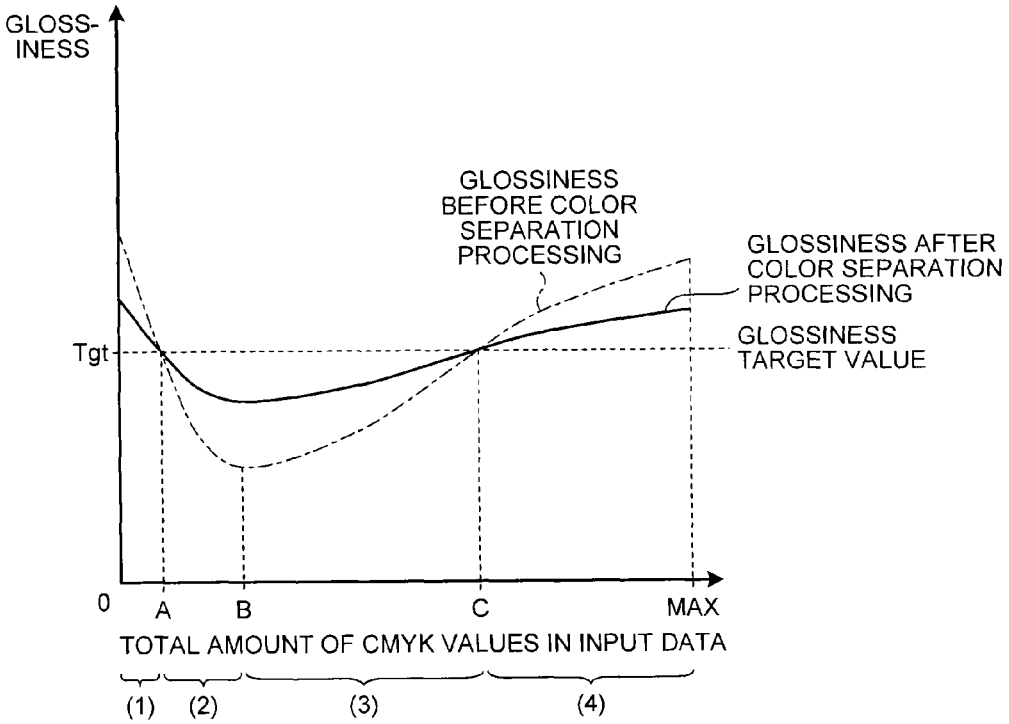
FIG. 30 is an exemplary graph conceptually illustrating correction of unevenness of glossiness after color separation processing in the seventh embodiment.

FIG. 30 is an exemplary graph conceptually illustrating correction of unevenness of the glossiness after the color separation processing in the seventh embodiment. In FIG. 30, a glossiness target value is assumed to be Tgt, CMYK total amount values on input data at two points as intersections between Tgt and the graph of the colored color material amount-to-glossiness table 5116 are assumed to be A and C, a CMYK total amount value at a point at which the glossiness is minimum is assumed to be B, a minimum value of the CMYK total amount value is assumed to be 0, and a maximum value thereof is assumed to be Max.

The color separation processing unit 5117 executes color replacement between the CMY values and the K value while setting the glossiness Tgt to the glossiness target value in respective sections of the total amount value. Note that an amount for which the color replacement can be executed is limited actually and the glossiness is not necessarily set to the Tgt value even when the color replacement is executed. For example, the case where the graph "glossiness after color separation processing" as illustrated in FIG. 30 is established, or the like, can be considered.

For coping with this, the clear color material amount determining unit 5151 determines the clear color material amount and the clear color material amount adjusting unit 5153 adjusts the clear color material amount relative to the Tgt value so as to try to achieve the Tgt value finally.

In the case of the example in FIG. 30, in a section 0 to A of the total amount value of the CMYK values on the input data, the clear color material amount adjusting unit 5153 reduces the glossiness such that the glossiness is closer to the Tgt value. The clear color material amount determining unit 5151 determines a reduction amount of the clear color material based on the decrease amount of the glossiness in this case by referring to the clear color material amount-to-glossiness table 5152 as illustrated in FIG. 29. In a section A to B, the clear color material amount adjusting unit 5153 increases the clear color material amount such that the glossiness is closer to the Tgt value. The clear color material amount determining unit 5151 determines an increase amount of the clear color material based on the increase amount of the glossiness in this case by referring to the clear color material amount-to-glossiness table 5152 as illustrated in FIG. 29 and the clear color material amount adjusting unit 5153 increases the clear color material amount. In the same manner, also in a section B to C, the clear color material amount determining unit 5151 determines the clear color material amount such that the glossiness is closer to the Tgt value and the clear color material amount adjusting unit 5153 increases the clear color material amount. In a section C to Max, as in the case of the section 0 to A, the clear color material amount determining unit 5151 determines the clear color material amount so as to reduce the clear color material amount and the clear color material amount adjusting unit 5153 reduces the clear color material amount. In the above-mentioned manner, the glossiness Tgt is tried to be achieved.

Figure 31:
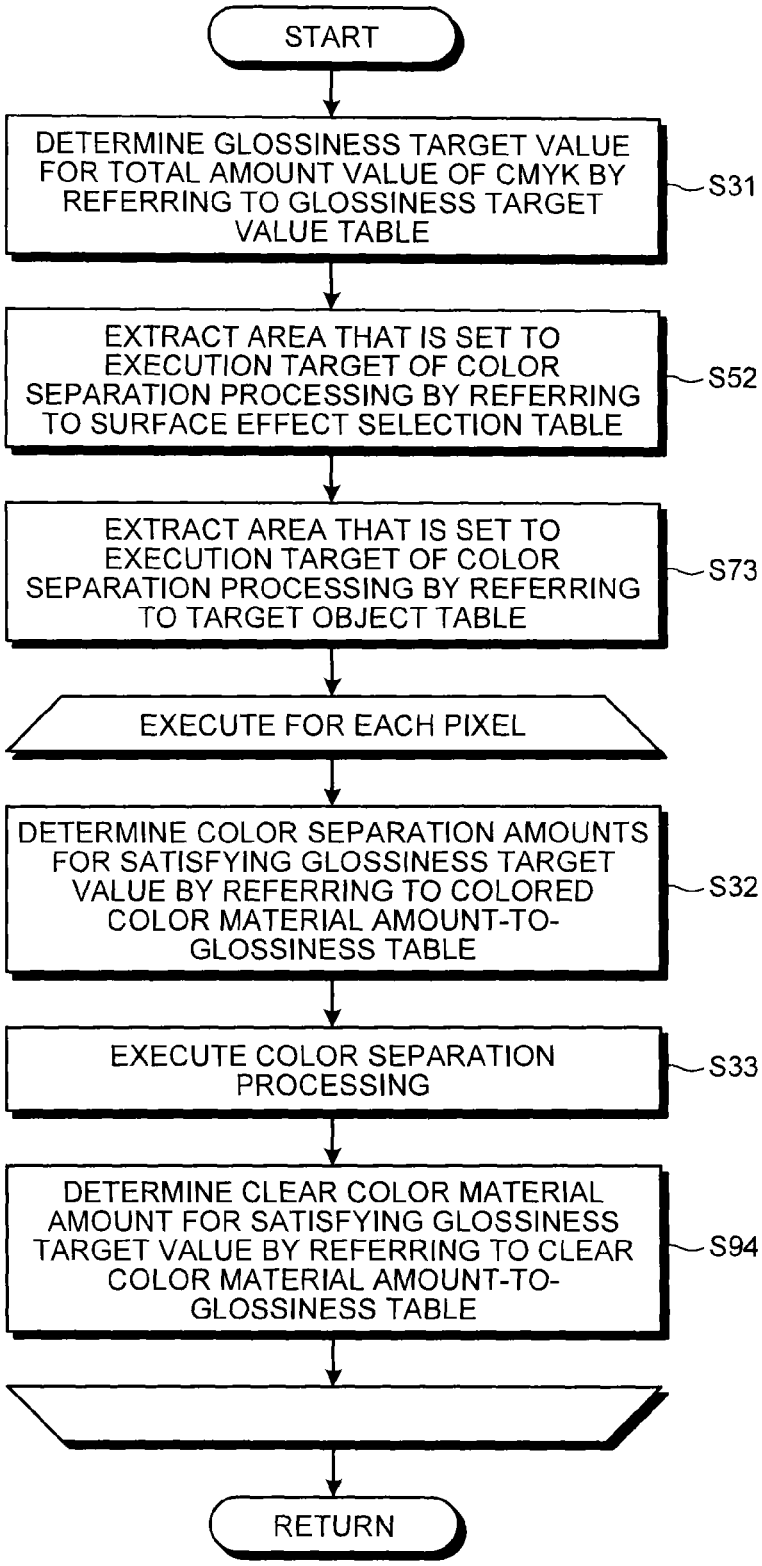
FIG. 31 is a flowchart illustrating an example of procedures of plane adjustment processing in the seventh embodiment.

FIG. 31 is a flowchart illustrating an example of procedures of plane adjustment processing in the seventh embodiment. Pieces of processing from the determination of the glossiness target value at step S31 to the color separation at S33 are performed in the same manner as those in the sixth embodiment.

When the color separation processing has completed, the clear color material amount determining unit 5151 determines the clear color material amount for satisfying the glossiness target value by referring to the clear color material amount-to-glossiness table 5152 (step S94). Then, the clear color material amount adjusting unit 5153 adjusts the clear color material amount to the clear color material amount determined at step S94 (step S95).

According to the seventh embodiment, not only the glossiness adjustment by the color separation processing unit 5117 but also processing of adjusting the amount of the clear color material by the clear color material amount adjusting unit 5153 are performed finally, so that the glossiness is further adjusted. As a result, the pieces of colored plane data 5121 and the gloss-control plane data 5122 are provided as the outputs from the plane adjusting unit 511.

When the sum of the color material amounts of the pieces of colored plane data and the gloss-control plane data provided as the outputs finally is larger than the total amount defined by an engine at a subsequent stage, processing of restricting the total amount of the color materials within a constant value may be executed using general total amount restricting processing.

Eighth Embodiment

In the first to the seventh embodiments, the color material amounts of the colored color materials are adjusted so as to eliminate the gloss difference on the entire surface, thereby improving print quality and reducing cost of the clear color material. When the glossiness is adjusted, known has been a technique of performing glossiness preview display processing in accordance with settings of presence or absence of a clear toner, an amount of a gloss toner, a sheet that is used, and the like in order to enable a user to visually check the glossiness before printing on the sheet.

There is the following conventional method of adjusting glossiness. That is, allocation of respective amounts of colored color materials to portions each having glossiness diverged from target glossiness is changed so as to adjust the total amount of the colored color materials. The adjustable amount is, however, limited and complete elimination of the difference in glossiness cannot be necessarily achieved actually. Due to this, the user cannot grasp the degree of achievement of the glossiness relative to the target glossiness before printing.

For solving this problem, in an eighth embodiment, the degree that the glossiness can be achieved relative to the target glossiness (glossiness target value) at the time of the printing is previously simulated and visualized, thereby enabling the user to check the glossiness before printing.

Figure 32:
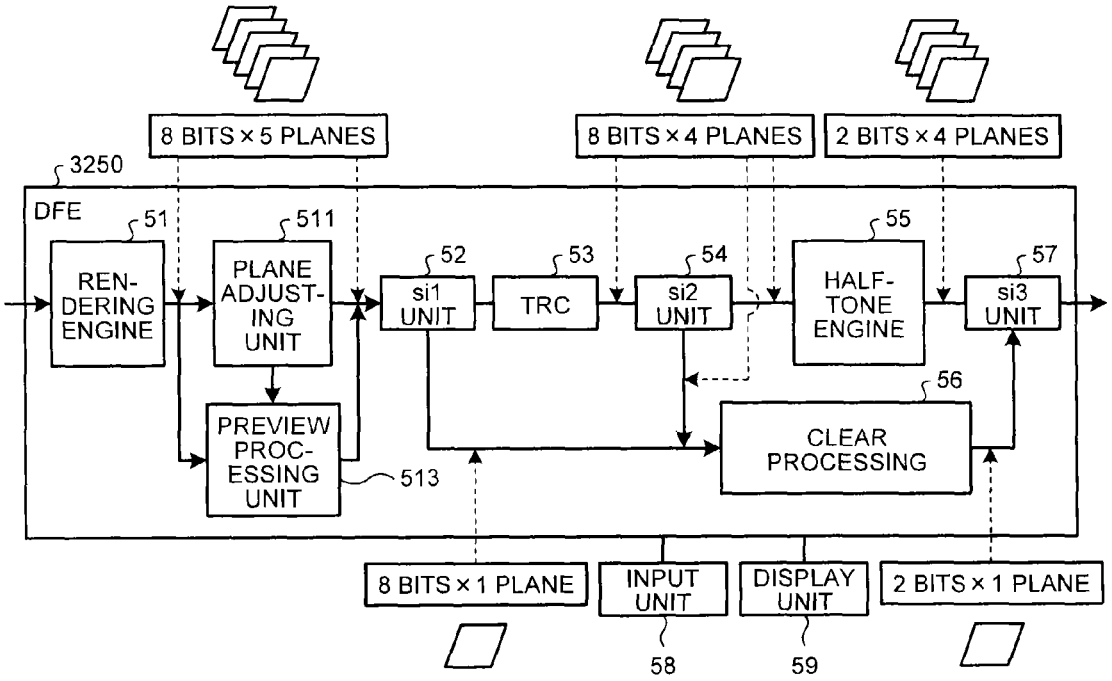
FIG. 32 is a block diagram illustrating the functional configuration of a DFE according to an eighth embodiment of the present invention.

Description of portions of the configuration of a printing system, the functions and configurations of the MIC 60 and the printing device 30, and processing flows in the eighth embodiment that are common to and overlapped with those in the first embodiment is omitted. FIG. 32 is a block diagram illustrating the functional configuration of a DFE 3250 in the eighth embodiment.

As illustrated in FIG. 32, the DFE 3250 includes the rendering engine 51, the plane adjusting unit 511, a preview processing unit 513, the si1 unit 52, the tone reproduction curve (TRC) 53, the si2 unit 54, the halftone engine 55, the clear processing 56, the si3 unit 57, the input unit 58, and the display unit 59. The functions and configurations of the rendering engine 51, the plane adjusting unit 511, the si1 unit 52, the TRC 53, the si2 unit 54, the halftone engine 55, the clear processing 56, the si3 unit 57, the input unit 58, and the display unit 59 are the same as those in the first embodiment.

The preview processing unit 513 generates a preview image of print data and displays the generated preview image on the display unit 59.

Figure 33:
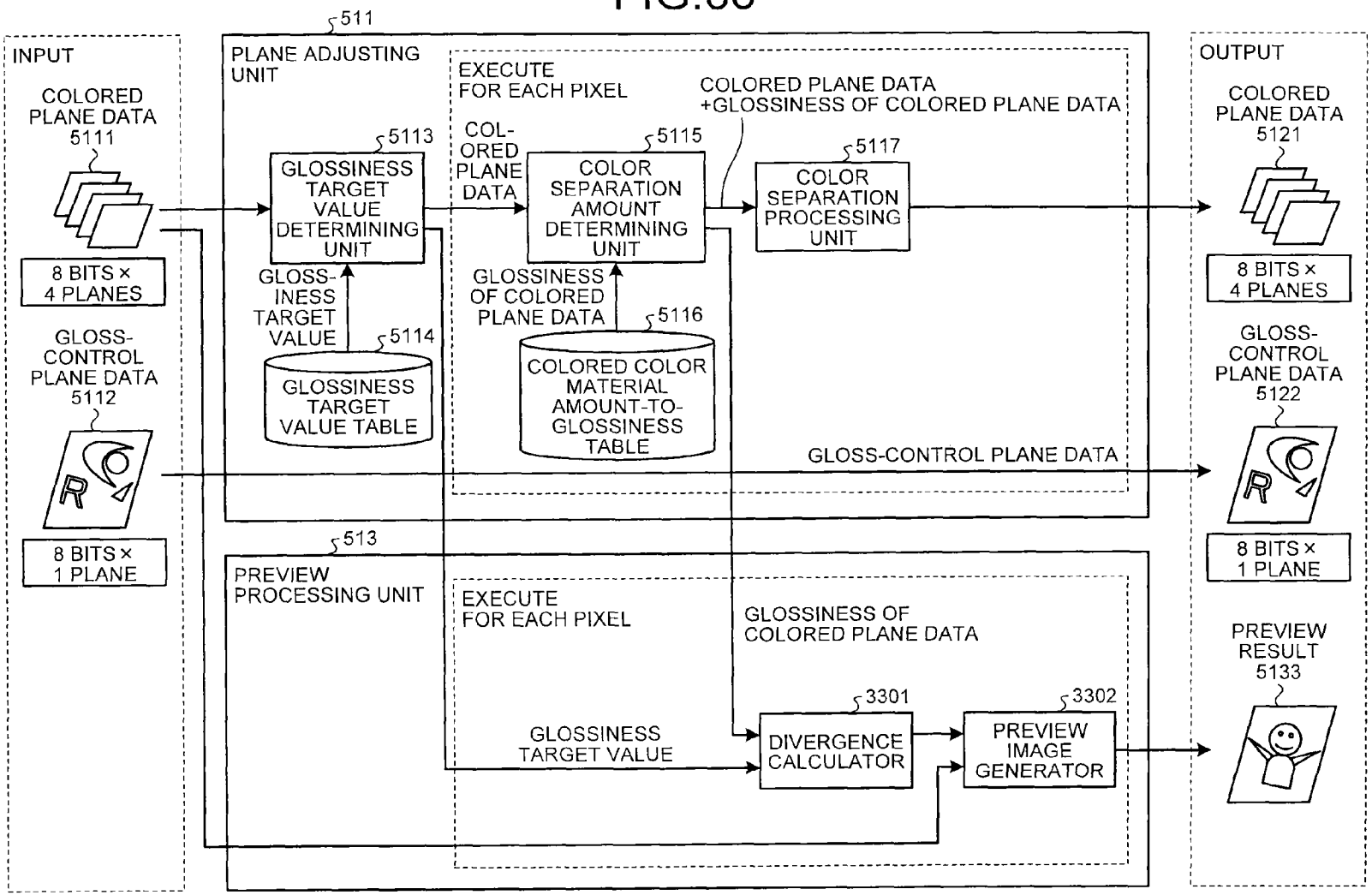
FIG. 33 is a block diagram illustrating the functional configuration of a plane adjusting unit and a preview processing unit in the eighth embodiment.

FIG. 33 is a block diagram illustrating the functional configurations of the plane adjusting unit 511 and the preview processing unit 513 in the eighth embodiment. As illustrated in FIG. 33, the functional configuration of the plane adjusting unit 511 is the same as that of the plane adjusting unit 511 in the first embodiment as illustrated in FIG. 10.

As illustrated in FIG. 33, the preview processing unit 513 includes a divergence calculator 3301 and a preview image generator 3302. The divergence calculator 3301 receives the respective pieces of colored plane data 5111 of CMYK, and calculates divergence as difference between glossiness after the color separation processing on the pieces of colored plane data 5111 by the color separation processing unit 5117 and the glossiness target value determined by the glossiness target value determining unit 5113 of the plane adjusting unit 511.

Figure 34:
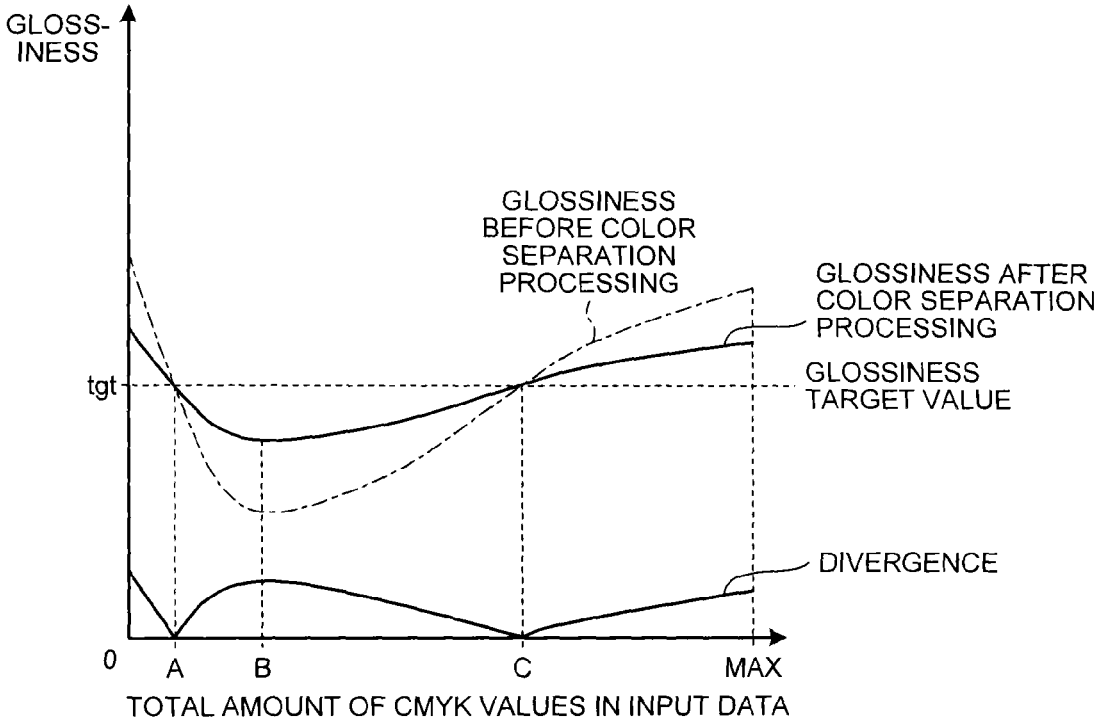
FIG. 34 is a graph for schematically explaining divergence in the eighth embodiment.

FIG. 34 is a graph for conceptually explaining the divergence in the eighth embodiment. The example of FIG. 34 illustrates a condition where the color separation processing unit 5117 executes the color separation processing for the glossiness target value as a target, so that the glossiness of the pieces of colored plane data 5111 as input image data is improved from glossiness before the color separation processing so as to be closer to the glossiness target value but the glossiness after the color separation processing is diverged from the glossiness target value. FIG. 34 illustrates, as the divergence, an absolute value of the difference between the glossiness target value and the glossiness after the color separation processing.

The glossiness is diverged over the entire input image more than a little and the level of the divergence is different depending on the total amount of the CMYK values on each pixel. The divergence is made visible on the input image so as to make the user to easily grasp the divergence. In the eighth embodiment, areas having large divergences are made visible and preview is displayed as will be described later.

Although the absolute value of the difference between the glossiness target value and the glossiness after the color separation processing is set to the divergence in the example of FIG. 34, the divergence is not limited thereto. Alternatively, the divergence calculator 3301 may be configured to calculate the divergence using an arbitrary calculation equation.

The preview image generator 3302 generates a preview image of the pieces of colored plane data 5111 of CMYK. To be specific, the preview image generator 3302 generates the preview image of the pieces of colored plane data 5111 of CMYK while distinguishing areas having divergences calculated by the divergence calculator 3301 that are equal to or larger than a certain value from other areas. The preview image generator 3302 transmits the generated preview image to the display unit 59. With this, the display unit 59 displays the preview image.

Figure 35:
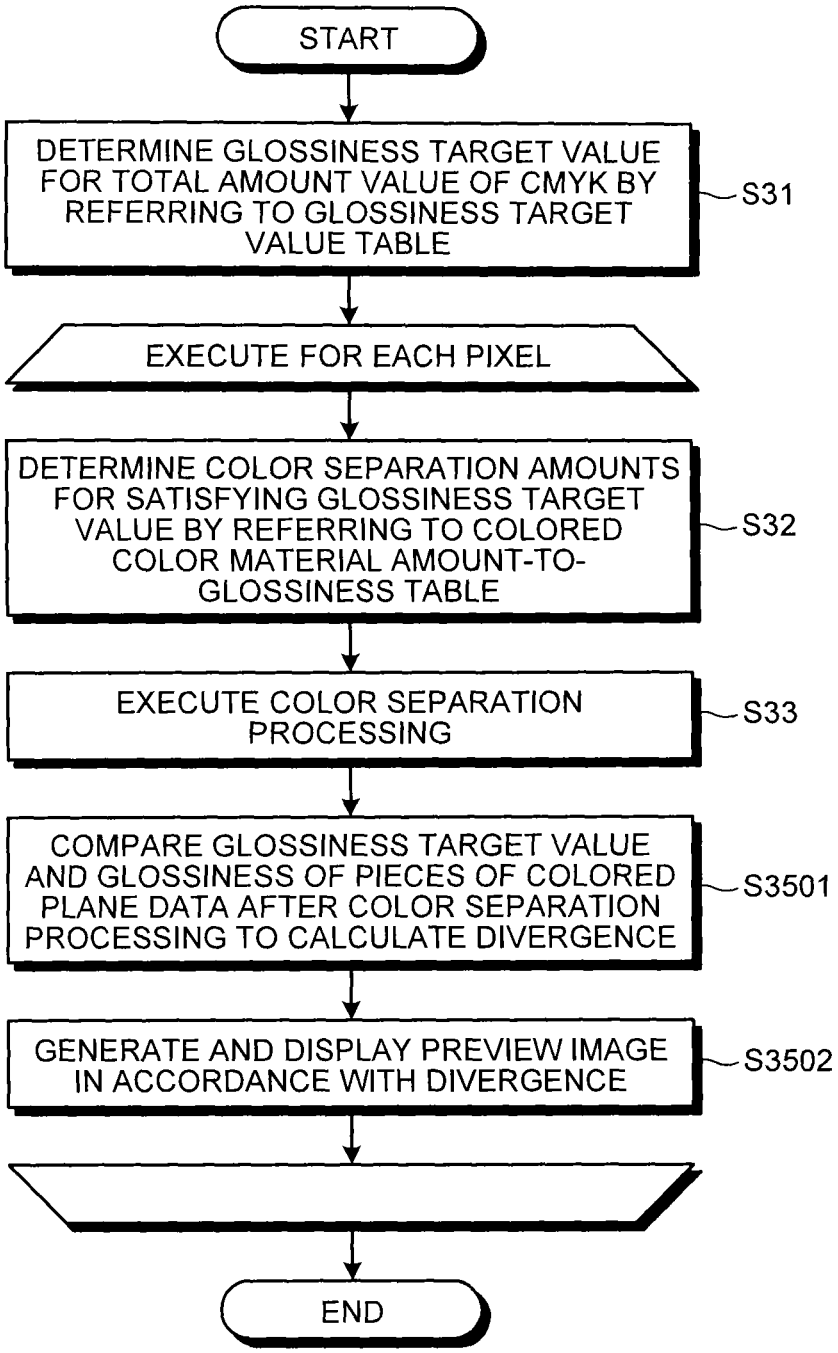
FIG. 35 is a flowchart illustrating an example of procedures of plane adjustment processing and preview image generation processing in the eighth embodiment.

FIG. 35 is a flowchart illustrating an example of procedures of the plane adjustment processing and preview image generation processing in the eighth embodiment. First, as in the first embodiment, the glossiness target value determining unit 5113 determines a glossiness target value for the total amount value of CMYK by referring to the glossiness target value table 5114 (step S31).

Subsequently, the following pieces of processing at step S32, S33, S3501, and S3502 are executed on the respective pixels of the pieces of colored plane data 5111 as image data as a print target. As in the first embodiment, at step S32, the color separation amount determining unit 5115 determines color separation amounts for satisfying the glossiness target value as described above by referring to the colored color material amount-to-glossiness table 5116 (step S32). That is to say, the color separation amount determining unit 5115 refers to the glossiness for the total amount of the CMYK values based on the colored color material amount-to-glossiness table 5116 so as to determine the degree of generated unevenness of the glossiness based on the difference between the glossiness relative to the total amount of the CMYK values and the glossiness target value and determine the degree of the color separation processing to be executed. With this processing, the degree of the glossiness of color planes after the color separation processing is determined. Then, the color separation amount determining unit 5115 performs the color separation processing based on the determined color separation amounts (step S33).

As described above, pieces of information of the glossiness target value and the glossiness of the color planes after the color separation processing can be obtained. After the color separation processing is finished, the divergence calculator 3301 compares the glossiness target value determined at step S31 with the glossiness of the pieces of colored plane data 5111 after the color separation processing at step S33 based on the information and obtains the difference therebetween so as to calculate the divergence (step S3501).

Thereafter, the preview image generator 3302 generates a preview image in accordance with the divergence and displays the generated preview image on the display unit 59 (step S3502).

FIG. 36 is a view illustrating the procedure of generation of the preview image in the eighth embodiment. The preview image generator 3302 examines the CMYK total amount value on each pixel for the pieces of colored plane data 5111 as the input image, performs mapping of the magnitudes of the values of the divergence expressed by the densities so as to generate the preview image like a preview result 5133. For example, the preview image like the preview result 5133 as illustrated in FIG. 36 indicates that divergence is high on portions of a face and both the hands and the divergence is not particularly generated on portions of a torso and background.

Although the magnitudes of the values of the divergence are displayed as the densities as they are and are mapped on the input image in FIG. 36, the display manner is not limited thereto. For example, as illustrated in FIG. 37, the preview image generator 3302 may be configured to extract and display only pixel areas having divergences of equal to or higher than a predetermined divergence through the preview image generation processing.

According to the eighth embodiment, the DFE 3250 generates and displays the preview image in accordance with the divergence between the glossiness target value and the glossiness after the color separation processing. This enables the user to check and determine the preview image on the display unit 59 before execution of printing so as to review print settings and design of the input image itself, thereby avoiding unnecessary printing.

That is to say, although the clear toner is more expensive than the colored toners and the cost thereof is increased, the eighth embodiment enables the user to check whether or not the glossiness of the intended glossiness target value can be achieved before printing. With this, the user can review document settings and print settings including a sheet that is used, setting of the clear plane, design (CMYK values) on portions having divergences of the glossiness, settings of a profile that is used, and a total amount restriction value. According to the eighth embodiment, waste printing can be reduced so as to save usage of the clear toner.

First Modification

The preview image generator 3302 can be configured to generate a list in which pixel values of pixels having divergences of equal to or higher than a certain value and frequencies as a part of the preview image. FIG. 38 is a table illustrating a list of the pixel values of the pixels having the divergences of equal to or higher than the certain value and frequencies according to a first modification of the embodiment. FIG. 38 illustrates an example in which the pixel values (CMYK) diverged from the glossiness target value are listed in the descending order of the frequency. Thus, the preview image generator 3302 displays the generated list on the display unit 59 together with the display example in FIG. 36 or FIG. 37 as a part of the preview result 5133 (as a preview image).

The preview image generator 3302 makes a list of specific values of the magnitudes of the divergences of the glossiness, color values of the pixels themselves, and frequencies so as to improve objectivity at the time of the preview display.

Although the example of FIG. 38 illustrates top four pixel values, it is not limited to four. Furthermore, although the example of FIG. 38 illustrates the CMYK values as the pixel values, the pixel values are not limited thereto. For example, the preview image generator 3302 may be configured to convert the CMYK values to Lab values using an arbitrary CMYK profile or the like and display them.

Second Modification

Furthermore, the preview image generator 3302 may be configured to generate an image indicating a positional relation between positions on a gamut and positions on the colored plane data as a part of the preview image for the pixels having divergence of equal to or higher than 0.

Figure 39:
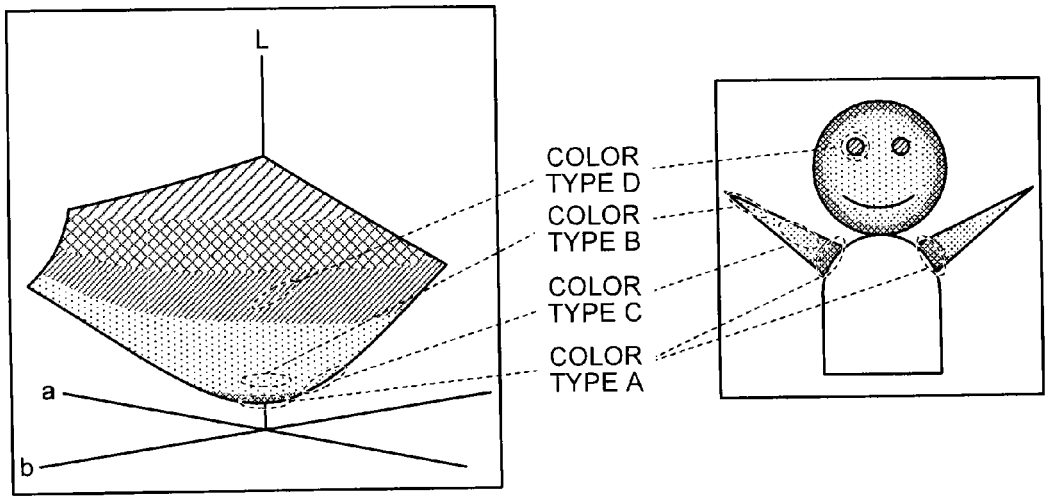
FIG. 39 is a view illustrating an example where a relation between positions of respective pixels having glossiness diverged from a glossiness target value on a gamut and positions thereof on colored plane data as an input image is displayed according to a second modification of the embodiment.

FIG. 39 is a view illustrating an example where a relation between positions of respective pixels having glossiness diverged from the glossiness target value on the gamut and positions thereof on colored plane data as an input image is displayed according to a second modification of the embodiment. The preview image generator 3302 generates the image as illustrated in FIG. 39 as a part of the preview result 5133, that is, a part of the preview image.

Although pixel areas at four places are illustrated, the number of pixel areas is not limited to four places.

In this manner, the preview image generator 3302 visualizes portions having large divergences of the glossiness in the input image and grasp correspondence positions on the gamut so as to make the user easy to grasp the divergences intuitively at the time of the preview display and further improve objectivity.

Third Modification

The divergence calculator 3301 may be configured to calculate the divergences, and then, convert the divergences to pieces of three-dimensional height information and the preview image generator 3302 may be configured to synthesize the converted pieces of three-dimensional height information and generate the preview image.

Figure 40:
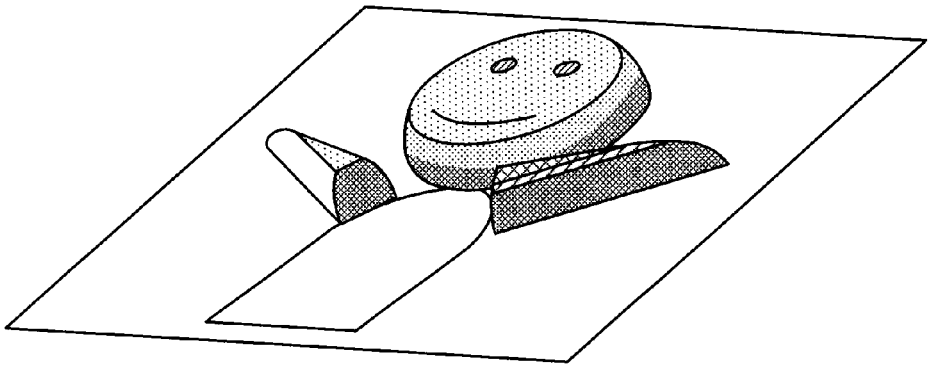
FIG. 40 is a view illustrating an example where divergences from a glossiness target value are converted to pieces of three-dimensional height information to be displayed according to a third modification of the embodiment.

FIG. 40 is a view illustrating an example where divergences from a glossiness target value are converted to pieces of three-dimensional height information to be displayed according to a third modification of the embodiment. The preview image generator 3302 generates an image as illustrated in FIG. 40 as a part of the preview result 5133, that is, a part of the preview image.

Although FIG. 40 illustrates the case where only pixel areas having divergences of equal to or higher than a predetermined divergence are visualized three-dimensionally, the display of the pixel areas is not limited to display of areas having the divergences of equal to or higher than the predetermined divergence.

In this manner, the preview image generator 3302 visualizes the magnitudes of the divergences of the glossiness in the input image three-dimensionally, so that the user is easy to grasp the divergences intuitively at the time of the preview display and further improve objectivity.

A printing control program, a plane adjusting program, and a preview processing program that are executed in the first to the eighth embodiments and modifications are embedded and provided in advance in a read only memory (ROM), for example.

The printing control program, the plane adjusting program, and the preview processing program that are executed in the first to the eighth embodiments and modifications may be recorded and provided in a non-transitory computer-readable recording medium such as a compact disc read only memory (CD-ROM), a flexible disk (FD), a compact disc recordable (CD-R), and a digital versatile disc (DVD), as an installable or executable file.

In addition, the printing control program, the plane adjusting program, and the preview processing program that are executed in the first to the eighth embodiments and modifications may be stored in a computer connected to a network such as the Internet and provided by being downloaded via the network. Furthermore, the printing control program, the plane adjusting program, and the preview processing program that are executed in the first to the eighth embodiments and modifications may be provided or distributed via a network such as the Internet.

The printing control program, the plane adjusting program, and the preview processing program that are executed in the first to the eighth embodiments and modifications may have a module configuration including the above-mentioned respective parts. As actual hardware, for example, the central processing unit (CPU) (processor) reads and executes the control programs from the ROM, so that the above-mentioned respective parts are loaded on a main storage device to be generated on the main storage device.

The present invention provides effects that print quality can be improved and cost of the clear color material can be suppressed by adjusting the amounts of the colored color materials to eliminate the gloss difference on the entire surface.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing control device comprising:

circuitry configured to:

determine a glossiness target value indicating a target of glossiness of image data as a print target;

determine color separation amounts of a plurality of colored color materials as amounts of the colored color materials to be allocated to respective colored color materials based on a sum of respective amounts of the colored color materials for the glossiness target value;

execute color replacement among a plurality of pieces of colored plane data based on the color separation amounts of the respective colored color materials; and generate the image data based on the plurality of pieces of the colored plane data on which the color replacement has been executed.

2. The printing control device according to claim 1, wherein the circuitry is configured to determine the glossiness target value in accordance with a type of a recording medium.

3. The printing control device according to claim 1, wherein the circuitry is configured to determine the glossiness target value based on gloss-control plane data specifying a type of a surface effect that is applied to a recording medium and an area on the recording medium to which the surface effect is applied.

4. The printing control device according to claim 1, wherein the circuitry is configured to determine the glossiness target value in accordance with a direction from a user.

5. The printing control device according to claim 1, wherein the circuitry is configured to:

extract an area to which a specific surface effect is applied based on gloss-control plane data specifying a type of a surface effect that is applied to a recording medium and an area on the recording medium to which the surface effect is applied, determine the color separation amounts of the respective colored color materials for the extracted area, and execute the color replacement based on the color separation amounts for the extracted area.

6. The printing control device according to claim 1, wherein the circuitry is configured to:

extract an object area as an area of a specific drawn object from the colored plane data, determine the color separation amounts of the respective colored color materials for the extracted object area, and execute the color replacement based on the color separation amounts for the extracted object area.

7. The printing control device according to claim 1, wherein the circuitry is configured to:

determine a clear color material amount as an amount of a clear color material based on glossiness after color separation processing on the plurality of pieces of the colored plane data, glossiness with gloss-control plane data specifying a type of a surface effect that is applied to a recording medium and an area on the recording medium to which the surface effect is applied, and the glossiness target value, and adjust the clear color material amount based on the determined clear color material amount.

8. The printing control device according to claim 1, wherein the circuitry is configured to:

calculate divergence, the divergence being a difference between glossiness after color separation processing on the plurality of pieces of the colored plane data and the glossiness target value, generate a preview image of the image data based on the divergence, and display the preview image.

9. The printing control device according to claim 8, wherein the circuitry is configured to generate the preview image indicating an area having the divergence equal to or higher than a certain value in a distinguished manner.

10. The printing control device according to claim 8, wherein the circuitry is configured to generate, as a part of the preview image, a list of a pixel value of a pixel having the divergence equal to or higher than a certain value and frequency.

11. The printing control device according to claim 8, wherein the circuitry is configured to generate, as a part of the preview image, an image indicating a positional relation between a position on a gamut and a position on the image data for a pixel having the divergence equal to or higher than 0.

12. The printing control device according to claim 8, wherein the circuitry is configured to:

convert the divergence to three-dimensional height information, and synthesize the three-dimensional height information so as to generate the preview image.

13. A printing control system that generates the image data and includes the printing control device according to claim 1.

14. A printing control method that is executed by a computer, the printing control method comprising:

determining a glossiness target value indicating a target of glossiness of image data as a print target;

determining color separation amounts of a plurality of colored color materials as amounts of the colored color materials to be allocated to respective colored color materials based on a sum of respective amounts of the colored color materials for the glossiness target value;

executing color replacement among a plurality of pieces of colored plane data based on the color separation amounts of the respective colored color materials; and generating the image data based on the plurality of pieces of the colored plane data on which color replacement has been executed.

15. A non-transitory computer-readable recording medium that contains a computer program that causes a computer to execute:

determining a glossiness target value indicating a target of glossiness of image data as a print target;

determining color separation amounts of a plurality of colored color materials as amounts of the colored color materials to be allocated to respective colored color materials based on a sum of respective amounts of the colored color materials for the glossiness target value;

executing color replacement among a plurality of pieces of colored plane data based on the color separation amounts of the respective colored color materials; and generating the image data based on the plurality of pieces of the colored plane data on which color replacement has been executed.

* * * * *